US008771818B2

(12) United States Patent
Nishioka et al.

(10) Patent No.: US 8,771,818 B2
(45) Date of Patent: Jul. 8, 2014

(54) ELECTRICALLY CONDUCTING MEMBER FOR ELECTROPHOTOGRAPHY, PROCESS CARTRIDGE AND ELECTROPHOTOGRAPHIC IMAGE FORMING APPARATUS

(71) Applicant: Canon Kabushiki Kaisha, Tokyo (JP)

(72) Inventors: Satoru Nishioka, Suntou-gun (JP); Satoru Yamada, Numazu (JP); Masahiro Watanabe, Mishima (JP); Kazuhiro Yamauchi, Suntou-gun (JP); Norifumi Muranaka, Yokohama (JP); Yuichi Kikuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/917,532

(22) Filed: Jun. 13, 2013

(65) Prior Publication Data

US 2013/0281275 A1 Oct. 24, 2013

Related U.S. Application Data

(63) Continuation of application No. PCT/JP2012/007987, filed on Dec. 13, 2012.

(30) Foreign Application Priority Data

Dec. 19, 2011 (JP) ..... 2011-277496

(51) Int. Cl.
*G03G 15/02* (2006.01)

(52) U.S. Cl.
CPC ..... *G03G 15/0233* (2013.01)
USPC ..... 428/36.91; 399/176

(58) Field of Classification Search
None
See application file for complete search history.

(56) References Cited

U.S. PATENT DOCUMENTS 6,127,622 A 10/2000 Yamada et al.
7,727,134 B2 6/2010 Nakamura et al.
7,947,339 B2 5/2011 Yamauchi et al.

(Continued)

FOREIGN PATENT DOCUMENTS

JP 7-121009 A 5/1995
JP 2003-202722 A 7/2003

(Continued)

OTHER PUBLICATIONS

Machine translation of JP 07-121009 A, May 1995.*

(Continued)

*Primary Examiner* — Ramsey Zacharia
(74) *Attorney, Agent, or Firm* — Fitzpatrick, Cella, Harper and Scinto

(57) ABSTRACT

To provide an electrically conducting member for electrophotography that has made itself kept from increasing in electrical resistance with time even in a low temperature and low humidity environment and also has made any ion conducting agent kept from bleeding to its surface. To also provide a process cartridge, and an electrophotographic image forming apparatus, that can stably form high-grade electrophotographic images over a long period of time in a variety of environments. The conductive member for electrophotography has an electrically conducting substrate and an electrically conducting layer, and the electrically conducting layer contains a resin having in the molecule at least one structure selected from structures represented by the formula (1), formula (2) and formula (3) each defined in the specification. The process cartridge and the electrophotographic image forming apparatus each make use of the same.

7 Claims, 2 Drawing Sheets

(56) References Cited

U.S. PATENT DOCUMENTS

| | | | |
|---|---|---|---|
| 8,176,632 | B2 | 5/2012 | Kawamura et al. |
| 8,298,670 | B2 | 10/2012 | Muranaka et al. |
| 8,449,975 | B2 | 5/2013 | Hirakoso et al. |
| 2012/0020700 | A1 | 1/2012 | Yamada et al. |
| 2012/0025143 | A1 | 2/2012 | Takeyama et al. |
| 2012/0195649 | A1 | 8/2012 | Kawamura et al. |
| 2012/0251171 | A1 | 10/2012 | Muranaka et al. |
| 2012/0263499 | A1 | 10/2012 | Yamauchi et al. |
| 2012/0281998 | A1 | 11/2012 | Kikuchi et al. |
| 2012/0308261 | A1 | 12/2012 | Tsuru et al. |
| 2013/0236213 | A1 | 9/2013 | Yamauchi et al. |
| 2013/0279936 | A1 | 10/2013 | Yamada et al. |
| 2013/0281276 | A1 | 10/2013 | Watanabe et al. |

FOREIGN PATENT DOCUMENTS

| | | | |
|---|---|---|---|
| JP | 2004-258277 | A | 9/2004 |
| JP | 2011-128264 | A | 6/2011 |
| JP | 2012-48198 | A | 3/2012 |

OTHER PUBLICATIONS

PCT International Search Report and Written Opinion of the International Searching Authority, International Application No. PCT/JP2012/007987, Mailing Date Feb. 12, 2013.

Kikuchi, et al., U.S. Appl. No. 13/875,202, filed May 1, 2013.

* cited by examiner

ELECTRICALLY CONDUCTING MEMBER FOR ELECTROPHOTOGRAPHY, PROCESS CARTRIDGE AND ELECTROPHOTOGRAPHIC IMAGE FORMING APPARATUS

CROSS-REFERENCE TO RELATED APPLICATIONS

This application is a continuation of International Application No. PCT/JP2012/007987, filed Dec. 13, 2012, which claims the benefit of Japanese Patent Application No. 2011-277496, filed Dec. 19, 2011 and Japanese Patent Application No. 2012-252745, filed Nov. 16, 2012.

BACKGROUND OF THE INVENTION

1. Field of the Invention

The present invention relates to an electrically conducting member for electrophotography, and to a process cartridge and an electrophotographic image forming apparatus which make use of the same.

2. Description of the Related Art

In electrophotographic image forming apparatus, conductive members are used in charging rollers, developing rollers, transfer rollers and so forth. These conductive members are desired to be so controlled as to have electrical resistance in a value of from $1\times10^5\Omega$ to $1\times10^{10}\Omega$. Hence, such an electrically conducting member is provided with an electrically conducting layer containing an electrically conducting agent.

Here, as conduction agents, an electronic conduction agent as typified by carbon black and an ion conducting agent such as a quaternary ammonium salt compound are known in the art.

The ion conducting agent may easily uniformly be dispersed in a binder resin as compared with the electronic conduction agent, and hence can be small in any electrical resistance non-uniformity that may be caused by non-uniform dispersion of the electrically conducting agent. On the other hand, such an electrically conducting layer having been made electrically conductive by the ion conducting agent may gradually increase in electrical resistance value because of application of direct voltage for a long time (hereinafter also "resistance change with time").

Such a resistance change with time is considered to be caused by the mechanism of conduction of the ion conducting agent. That is, the ion conducting agent undergoes dissociation into the cation and the anion and the respective ions move in accordance with the electric field gradient, thereby bringing out the conductivity. Hence, the number of such ions movable in through the electrically conducting layer becomes smaller with time, and this causes the resistance change with time, as so considered. Also, since the ion conducting agent stands added to the binder resin, in a case where the electrically conducting layer constitutes a surface layer, it may come about that the ion conducting agent soaks out of the conductive member to its surface (hereinafter also "bleeding") and adheres to the surface of a member coming in contact with the conductive member, to affect the grade of electrophotographic images.

Regarding how the conductive member having an electrically conducting layer containing the ion conducting agent be kept from causing the resistance change with time, Japanese Patent Application Laid-Open No. 2004-258277 discloses that a quaternary ammonium salt having a glycidyl group that is a reactive functional group is used as the ion conducting agent.

SUMMARY OF THE INVENTION

According to studies made by the present inventors, the quaternary ammonium salt having a glycidyl group disclosed in Japanese Patent Application Laid-Open No. 2004-258277 can react with a functional group such as a hydroxyl group, carboxylic acid group or amino group present in the binder resin, to form a covalent bond. Hence, this quaternary ammonium salt comes stationary in the binder resin, so that the bleeding can be kept from occurring and, also regarding the resistance change with time, it can somewhat be kept from being caused, as so ascertainable.

However, where a roller making use of the conductive material according to Japanese Patent Application Laid-Open No. 2004-258277 is used in an electrophotographic apparatus and a direct voltage is continued to be applied thereto over a long period of time, it has still come about that the electrical resistance changes with time. As the result, it has come about that, where such a roller is used as a charging member, horizontal linear non-uniformity comes to appear in electrophotographic images because of an increase in electrical resistance with time. It has also come about that, where such a roller is used as a developing member or a transfer member, electrophotographic images come to decrease in density because of an increase in electrical resistance with time. Then, this tendency has been found to be remarkable when such a roller is used in a low temperature and low humidity environment (e.g., temperature: 15° C. and relative humidity: 10%).

As a reason therefor, the present inventors consider it to be due to the fact that the ionic conduction performance of the quaternary ammonium salt having a glycidyl group is susceptible to the water content in the binder resin.

More specifically, it is considered to be one cause that, in the low temperature and low humidity environment, the absolute amount of water contained in the binder resin is so small as to provide not necessarily sufficient ionic dissociation for the quaternary ammonium salt having a glycidyl group, so that the amount of ions contributing to conductivity decreases with service unwantedly.

The present invention has been made taking account of such a technical background. Accordingly, the present invention is directed to providing an electrically conducting member for electrophotography that has made itself kept from increasing in electrical resistance with time even in a low temperature and low humidity environment and also has made any ion conducting agent kept from bleeding to its surface.

Further, the present invention is directing to providing a process cartridge, and an electrophotographic image forming apparatus, that can stably form high-grade electrophotographic images over a long period of time in a variety of environments.

According to one aspect of the present invention, there is provided an electrically conducting member for electrophotography comprising an electrically conducting substrate and an electrically conducting layer, wherein the electrically conducting layer comprises a resin having in the molecule at least one structure selected from the group consisting of structures represented by the following formula (1), formula (2) and formula (3):

Formula (1)

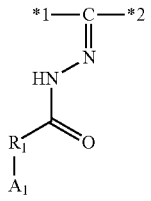

Formula (2)

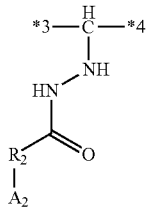

Formula (3)

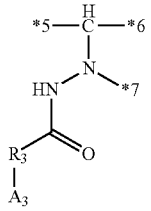

In the formulas (1) to (3), $R_1$ to $R_3$ each independently represent an alkylene group having 1 to 10 carbon atom(s); and asterisks *1 to *7 each independently represent a hydrogen atom or the position of bonding with the carbon atom in the molecular structure of the resin, provided that at least one of *1 and *2, at least one of *3 and *4 and at least one point selected from *5 to *7 represents the position of bonding with the carbon atom in the molecular structure of the resin.

$A_1$ to $A_3$ each independently represent any structure selected from the group consisting of structures represented by the following formula (4), formula (5), formula (6) and formula (7):

Formula (4)

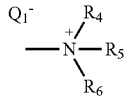

Formula (5)

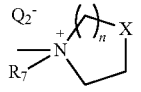

Formula (6)

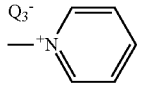

Formula (7)

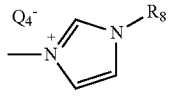

In the formulas (4) to (7), $Q_1^-$ to $Q_4^-$ each independently represent an anion; $R_4$ to $R_8$ each independently represent an alkyl group having 1 to 8 carbon atom(s) which has been substituted with an oxyalkylene group having 1 to 4 carbon atom(s), an allyl group, or an alkyl group having 1 to 14 carbon atom(s); X represents a methylene group or an oxygen atom; and n represents 1 or 2.

According to another aspect of the present invention, there is provided a process cartridge which is so constituted as to be detachably mountable to the main body of an electrophotographic image forming apparatus, and has the above conductive member for electrophotography.

According further aspect of the present invention, there is provided an electrophotographic image forming apparatus which has the above conductive member for electrophotography.

According to the present invention, an electrically conducting member for electrophotography can be obtained which has a sufficient conductivity even in a low temperature and low humidity environment and has made itself kept from increasing in electrical resistance even when a direct voltage is continued to be applied thereto, also having made any bleeding kept from occurring from the electrically conducting layer.

According to the present invention, a process cartridge and an electrophotographic image forming apparatus can be obtained which can stably form high-grade electrophotographic images over a long period of time in a variety of environments.

Further features of the present invention will become apparent from the following description of exemplary embodiments with reference to the attached drawings.

DESCRIPTION OF THE EMBODIMENTS

Figure 1A:
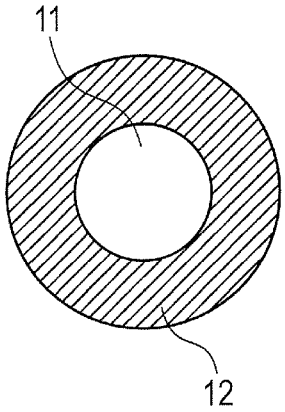
FIG. 1A is a schematic sectional view showing a first example of the conductive member for electrophotography of the present invention.

Preferred embodiments of the present invention will now be described in detail in accordance with the accompanying drawings.

The present inventors have taken note of the dissociativity of the quaternary ammonium salt and the movement and diffusion of the quaternary ammonium salt, in order to obtain an electrically conducting member for electrophotography which can attain sufficient conductivity even in a low temperature and low humidity environment, may less cause any change in electrical resistance with time, and makes any ion conducting agent (quaternary ammonium salt) kept from bleeding.

Here, conductivity σ in ionic conduction may be shown by the following mathematical expression 1.

$$\sigma = e \times d \times \mu \quad \text{Math. 1}$$

Here, σ refers to the conductivity; e, the electric charge of a carrier; d, the carrier density; and μ, the mobility of the carrier. In the case of ionic conduction, the carrier is an ion conducting agent having been ionized by the dissociation into the cation and the anion. In general, the ion conducting agent is formed of i) an ion exchange group such as a quaternary ammonium base and ii) an ion with a polarity opposite thereto, and both the ions move in through the binder resin, thereby exhibiting the ionic conductivity.

Water in the binder resin promotes the ionic dissociation of the quaternary ammonium salt, and hence it increases the value d in the mathematical expression 1. That is, the largest factor that makes the value of electrical resistance change greatly depending on service environments is considered to be a change in water content in the binder resin. Therefore, it is considered that, in the low temperature and low humidity environment, in which the water content in the binder resin is small, the value d in the mathematical expression 1 decreases, so that the resistance comes high. That is, in order to attain a sufficient conductivity in the low temperature and low humidity environment, it is important that the quaternary ammonium salt can undergo dissociation even if the binder resin is in a water-free state.

It is also considered that, as stated above, the resistance change with time is caused when cations and anions come localized upon electrification to make movable carriers (d in the mathematical expression 1) less in number. Therefore, it is considered that making the electrical resistance less change with time can be achieved by shortening the time of movement for which the cation and the anion make a pair from the state in which both the ions are localized.

Usually, in the ion conducting agent, both the ions, the cation and the anion, move individually, and hence take a long distance until they make a pair. Thus, either of the cation and the anion, constituting the quaternary ammonium salt, may be made stationary in the binder resin so as to form a state of being difficult to move, and this can shorten the time by which they form an ion pair, as so considered.

It is also considered that making either of the ions in the quaternary ammonium salt stationary in the binder resin can simultaneously keep the quaternary ammonium salt from soaking out of the surface of the conductive member.

Accordingly, the present inventors have studied in order to succeed in attaining a sufficient conductivity in the low temperature and low humidity environment, making the electrical resistance less change with time and keeping the quaternary ammonium salt from soaking out of the surface. Stated more specifically, they have studied so as to make the cationic group in the quaternary ammonium salt stationary in the binder resin through an electron donating linking group.

As the result, they have discovered that the use of a binder resin having in the molecule at least one structure of structures respectively represented by the above formulas (1), (2) and (3) enables the conductive member to attain sufficient conductivity even in a low temperature and low humidity environment, less cause any change in electrical resistance with time and make any quaternary ammonium salt kept from bleeding to its surface.

As to the reason why such an effect can be obtained, the present inventors presume it as stated below.

Any of the structures represented by the formulas (1) to (3) includes the quaternary ammonium salt structure represented by any of the formulas (4) to (7), and the cationic group in this salt structure stands bonded to the carbon atom in the molecular structure of the binder resin through the linking group that includes the structural moiety coming from hydrazine (═N—NH—CO—, —NH—NH—CO—, or —N-(*7)-NH—CO—). That is, the cationic group in the quaternary ammonium salt has been made stationary in the binder resin.

The structural moiety coming from hydrazine that exists in the above linking group is commonly known to coordinate with a metal ion, and is an electron donating linking group. This structural moiety coming from hydrazine is present in the vicinity of the cationic group of the quaternary ammonium salt [in the formulas (1) to (3), in an equal weight in molar ratio], and thereby donates electrons efficiently to promote the dissociation of the quaternary ammonium salt, as so considered. It is considered that, in virtue of this effect, the sufficient conductivity can be attained even in the low temperature and low humidity environment in which any water contained in the binder resin is in a small quantity.

In addition, since the cationic group in the quaternary ammonium salt has been made stationary in the binder resin, this cationic group can not move even upon electrification, and only the anionic group ($Q^-$) moves. As the result, compared with a case in which the ion conducting agent has not been made stationary, the distance between the cationic group and the anionic group in the quaternary ammonium salt is considered to come smaller, and the resistance change with time is considered to be less caused. Also about the bleeding of the quaternary ammonium salt, it is considered to be kept from occurring, as having been made thus stationary.

Conductive Member for Electrophotography

The conductive member for electrophotography of the present invention has an electrically conducting substrate and an electrically conducting layer provided on the electrically conducting substrate. The conductive member for electrophotography of the present invention may be used as an electrically conducting member used in an image forming apparatus that utilizes electrophotography. Stated specifically, it may preferably be used as a charging member provided in contact with a charging object member such as a photosensitive drum so as to charge this charging object member electrostatically. Besides the charging member, such as a charging roller, the present conductive member may also be used as a developing member, a transfer member, a charge elimination (destaticizing) member, and a transport member such as a paper feed roller. As the shape of the conductive member, it may be, e.g., roller-shaped or belt-shaped.

In the following, as an example of embodiments of the conductive member for electrophotography, it is described taking note of a roller-shaped conductive member for electrophotography, in particular, a roller-shaped charging member (charging roller), to which, however, the use of the present invention is by no means limited.

Figure 1B:
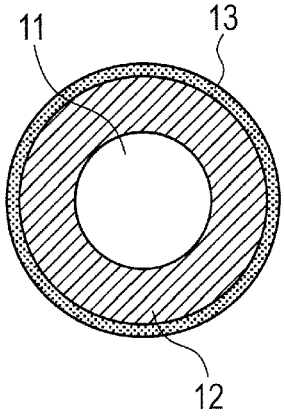
FIG. 1B is a schematic sectional view showing a second example of the conductive member for electrophotography of the present invention.
Figure 1C:
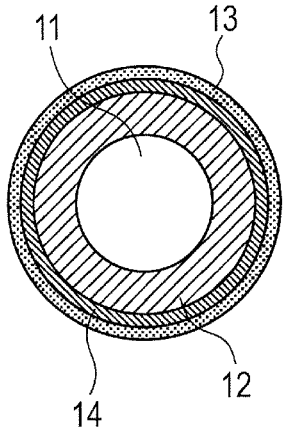
FIG. 1C is a schematic sectional view showing a third example of the conductive member for electrophotography of the present invention.

Schematic sectional views of three examples of the conductive roller of the present invention (schematic sectional views of conductive rollers as viewed when cut perpendicularly to the axial direction of their conductive shaft members each) are given in FIGS. 1A, 1B and 1C.

The conductive roller according to the present invention may be, as shown in FIG. 1A, constituted of a conductive shaft member 11 (e.g., a mandrel) that is the electrically conducting substrate, and provided on its peripheral surface, an elastic layer 12. In this case, the elastic layer 12 is an electrically conducting layer containing the resin having in the molecular structure (in the molecule) at least one structure of structures respectively represented by the above formulas (1), (2) and (3) (i.e., cationic group-immobilized electrically conducting resin).

The conductive roller may also have, as shown in FIG. 1B, a surface layer 13 provided on the surface of the elastic layer 12. In this case, any one or both of the elastic layer 12 and the surface layer 13 may be the electrically conducting layer containing the cationic group-immobilized electrically conducting resin. In other words, the electrically conducting layer containing this resin and any other conduction layer (e.g., one conventionally known in the field of electrophotographic image forming apparatus) may be used in combination.

The conductive roller may still also have, as shown in FIG. 1C, a triple-layer structure in which an intermediate layer 14 is provided between the elastic layer 12 and the surface layer 13 or a multiple-layer structure in which a plurality of intermediate layers are provided between the elastic layer 12 and the surface layer 13. In this case, at least one layer selected from the group consisting of the elastic layer 12, the surface layer 13 and one or more intermediate layer(s) may be the electrically conducting layer containing the cationic group-immobilized electrically conducting resin, and this conduction layer and any other conduction layer may be used in combination.

Where the conductive roller has as a surface layer the electrically conducting layer containing the cationic group-immobilized electrically conducting resin, this conduction layer may preferably have a thickness of from 1 μm or more to 100 μm or less, from the viewpoint of securing a proper contact width for any other member coming in contact with the electrically conducting layer. Also, where the electrically conducting layer containing the cationic group-immobilized electrically conducting resin is used as a layer provided between the electrically conducting substrate and the surface layer, this conduction layer may preferably have a thickness of from 1 μm or more to 3 μm or less, from the viewpoint of controlling its electrical resistance.

Each layer formed on the electrically conducting substrate may have electrical resistance in a value of approximately from $1\times10^3$ Ω·cm or more to $1\times10^9$ Ω·cm or less.

In particular, the electrically conducting layer containing the cationic group-immobilized electrically conducting resin may preferably have electrical resistance in a value of from $1\times10^5$ Ω·cm or more to $1\times10^8$ Ω·cm or less. As being within this range, any abnormal discharge due to leak, and the like can more effectively be kept from occurring.

Conductive Substrate

As the electrically conducting substrate, it may appropriately be selected from those used in the field of the conductive member for electrophotography. For example, it may include a columnar shaft member obtained by plating a columnar carbon steel alloy with nickel on its surface in a thickness of about 5 μm. Also, from the viewpoint of improvement in adherence between the electrically conducting substrate and any layer to be provided thereon, an adhesive may be applied to the surface of the substrate.

Conduction Layer

The electrically conducting layer used in the present invention contains the resin having in the molecular structure at least one structure of structures respectively represented by the following formula (1), formula (2) and formula (3) (the cationic group-immobilized electrically conducting resin). This cationic group-immobilized electrically conducting resin may be contained in the electrically conducting layer in a cross-linked state. The electrically conducting layer may also be composed of (constituted of) this resin, and may contain, besides this resin, various additive described later. Here, the cationic group-immobilized electrically conducting resin in the electrically conducting layer may preferably be in a content of 10% by mass or more from the viewpoint of conductivity, and much preferably 30% by mass or more. This content may be determined by NMR.

Any of the structures respectively represented by the following formulas (1) to (3) may be contained in the cationic group-immobilized electrically conducting resin in a proportion of from 0.01% by mass or more to 20% by mass or less in total, from the viewpoint of conductivity. This proportion of content may also be determined by NMR.

Formula (1)

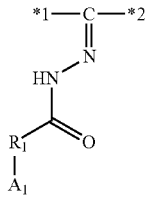

Formula (2)

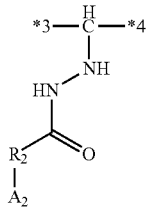

Formula (3)

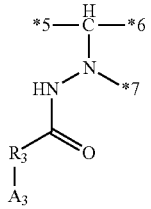

In the formulas (1) to (3), $R_1$, $R_2$ and $R_3$ each independently represent an alkylene group having 1 to 10 carbon atom(s). Inasmuch as the groups $R_1$ to $R_3$ each present between the structural moiety coming from hydrazine that promotes the ionic dissociation in the cationic group-immobilized electrically conducting resin and the cationic group in the quaternary ammonium salt structure ($A_1$ to $A_3$ each) is an alkylene group having 1 to 10 carbon atom(s), the structural moiety coming from hydrazine and the cationic group can be made present at a distance that is spatially close. Hence, the conductive member according to the present invention is considered to be what can exhibit a sufficient conductivity even in a low temperature and low humidity environment. Here, the alkylene group having 1 to 10 carbon atom(s) may be either of branched-chain and straight-chain. From the viewpoint of conductivity in a low temperature and low humidity environment, $R_1$ to $R_3$ may each preferably be a methylene group, having 1 carbon atom.

The asterisks *1 to *7 each independently represent a hydrogen atom or the position of bonding with the carbon atom in the molecular structure of the cationic group-immobilized electrically conducting resin, provided that at least one of *1 and *2, at least one of *3 and *4 and at least one point selected from *5 to *7 represents the position of bonding with the carbon atom in the molecular structure of the cationic group-immobilized electrically conducting resin.

That is, in the present invention, at least one of the structures represented by the formulas (1) to (3) is set stationary in the conductive resin. This carbon atom may be the carbon atom in the polymer side chain or atomic group of the above resin. Also, all the asterisks *1 to *7 may each represent the position of bonding with the carbon atom in the molecular structure of the resin.

$A_1$ to $A_3$ each independently represent a structure selected from the group consisting of structures respectively represented by the following formula (4), formula (5), formula (6) and formula (7). Here, it is desirable that the structure of the cationic group in the quaternary ammonium salt structure [any of Formulas (4) to (7)] is a structure having less steric hindrance so that electrons may readily be donated thereto from the structural moiety coming from hydrazine and the water molecule, and it is also desirable that the quaternary ammonium salt itself has a structure that may help the ionic dissociation.

Formula (4)

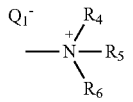

Formula (5)

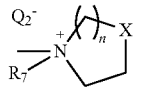

Formula (6)

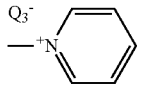

Formula (7)

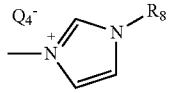

In the formulas (4) to (7), $R_4$ to $R_8$ each independently represent an alkyl group having 1 to 8 carbon atom(s) which has been substituted with an oxyalkylene group having 1 to 4 carbon atom(s) (the former's carbon atom(s) being not inclusive of the carbon atom(s) of the latter's oxyalkylene group), an allyl group, or an alkyl group having 1 to 14 carbon atom(s). In the present invention, the oxyalkylene group refers to a group represented by $—[(OR_{12})_mOR_{13}]$. Herein, $R_{12}$ represents an alkylene group having 1 to 3 carbon atom(s), $R_{13}$ represents an alkyl group having 1 to 4 carbon atom(s), and m is an integer of 0 to 3. Further, the position of substitution of the alkyl group having 1 to 8 carbon atom(s) with the oxyalkylene group may appropriately be selected.

As $R_4$ to $R_6$ in the formula (4) being each an alkyl group having 1 to 14 carbon atom(s) or an allyl group, the structure can be made to have less steric hindrance and can promote the ionic dissociation. Also, as $R_4$ to $R_6$ being each an alkyl group having 1 to 8 carbon atom(s) which has been substituted with an oxyalkylene group having 1 to 4 carbon atom(s), the ionic dissociation can be promoted by the oxyalkylene group.

In the formula (5), X represents a methylene group or an oxygen atom, and n represents 1 or 2. As n being 1 or 2 and X being a methylene group or an oxygen atom, the structure can be made to have less steric hindrance and hence can promote the ionic dissociation. Also, as $R_7$ in the formula (5) being an alkyl group having 1 to 14 carbon atom(s) or an allyl group, the cationic group can be made to have less steric hindrance. Further, as $R_7$ being an alkyl group having 1 to 8 carbon atom(s) which has been substituted with the oxyalkylene group, the ionic dissociation can be promoted by the oxyalkylene group.

The salt structure represented by the formula (6) has aromaticity, and hence it can lessen the cationic charge on the nitrogen atom and can promote the ionic dissociation.

As $R_8$ in the formula (7) being an alkyl group having 1 to 14 carbon atom(s) or an allyl group, the structure can be made to have less steric hindrance and also has aromaticity, and hence it can lessen the cationic charge on the nitrogen atom and can promote the ionic dissociation. Also, as $R_8$ being an alkyl group having 1 to 8 carbon atom(s) which has been substituted with the oxyalkylene group, the ionic dissociation can be promoted by the oxyalkylene group.

However, from the viewpoints of having less steric hindrance and making the ionic dissociation readily promotable, it is preferable that any of $A_1$, $A_2$ and $A_3$ represent the structure represented by the formula (4), and further, it is particularly preferable that $R_4$ to $R_6$ in this formula (4) each independently represent an alkyl group having 1 to 3 carbon atom(s).

In the formulas (4) to (7), $Q_1^-$ to $Q_4^-$ each independently represent an anion. The anion may include, e.g., halide ions such as a fluoride ion, a chloride ion, a bromide ion and an iodide ion; sulfonic acid compound ions such as a sulfonyl imide ion, a trifluoromethanesulfonate ion and a p-toluenesulfonate ion; phosphoric acid compound ions such as a hexafluorophosphate ion and a dipmethylphosphate ion; boric acid compound ions such as a tetrafluoroborate ion and a tetracyanoborate ion; and perchlorate ions. The sulfonyl imide ion may include, e.g., a perfluorosulfonyl imide ion represented by the following formula (8).

The above anions ($Q_1^-$ to $Q_4^-$) may each preferably be the perfluorosulfonyl imide ion represented by the formula (8). The perfluorosulfonyl imide ion exhibits a higher conductivity than any other anions, and hence it is preferable in view of an advantage that it can bring out a higher conductivity in a low temperature and low humidity environment.

Further, the perfluorosulfonyl imide ion is highly hydrophobic, and hence, compared with commonly available highly hydrophilic ions, it may easily have a higher affinity for binder resin raw materials described later. As the result, a reactive group-containing quaternary ammonium salt described later may easily uniformly be dispersed in and react with the binder resin raw materials, to make the quaternary ammonium salt cation stationary in the binder resin, and hence it is preferable in view of an advantage that it can lessen any electrical resistance non-uniformity that may be caused by non-uniform dispersion of the electrically conducting agent.

Formula (8)

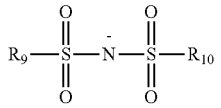

In the formula (8), $R_9$ and $R_{10}$ each independently represent a perfluoroalkyl group having 1 to 4 carbon atom(s). The number of carbon atom(s) in this perfluoroalkyl group is set to be 1 or more to 4 or less, from the viewpoint of conductivity.

The perfluorosulfonyl imide ion may specifically include, but is not limited to, a bis(trifluoromethanesulfonyl imide ion (TFSI), a bis(pentafluoroethanesulfonyl) imide ion and a bis (nonafluorobutanesulfonyl) imide ion (NFSI).

Identification of Structures Represented by Formulas (1) to (3):

The cationic group set stationary in the cationic group-immobilized electrically conducting resin of the electrically conducting layer and the anionic group standing free therein may be identified in the following way. The electrically conducting layer is partly cut out, and then treated by extraction with use of a solvent such as ethanol. For the solid matter obtained, infrared spectroscopic (IR) analysis is made, whereby whether or not the linkage of an ion exchange group (cationic group) is present can be identified. Similarly, for the extract obtained and the extraction residue, solid matter $^{13}C$-NMR measurement and mass spectrometry making use of a time-of-flight mass spectrometric analyzer (TOF-MS) may be made, and this enables identification of the molecular structure inclusive of the cationic group.

In order to more surely keep the electrically conducting layer according to the present invention from increasing in electrical resistance value in a low temperature and low humidity environment, it is preferable for the cationic group-immobilized electrically conducting resin according to the present invention to have an alkylene oxide (AO) structure.

Introduction of the alkylene oxide structure into the molecule makes the binder resin hold water content with ease, and hence this can more promote the ionic dissociation in the quaternary ammonium salt structure represented by any of the formulas (4) to (7). This enables the electrically conducting layer to be more surely kept from increasing in electrical resistance even in a low temperature and low humidity environment.

Herein, the alkylene oxide structure may specifically include an ethylene oxide (EO) structure, a propylene oxide (PO) structure, a butylene oxide structure and an α-olefin oxide structure, and one or two or more types of any of these structures may optionally be contained in the cationic group-immobilized electrically conducting resin.

Such an alkylene oxide unit in the cationic group-immobilized electrically conducting resin may preferably be in a content of 10% by mass from the viewpoint of electrical resistance in a low temperature and low humidity environment. This content may be determined by NMR.

Of the above alkylene oxides, especially where the ethylene oxide is used from the viewpoint of the ionic dissociation, the effect of keeping the electrically conducting layer from increasing in electrical resistance in a low temperature and low humidity environment can be more remarkable.

The ethylene oxide structure has a higher hydrophobicity than any other alkylene oxide structures, and hence, in the case when the ethylene oxide structure is introduced into the cationic group-immobilized electrically conducting resin, the amount in which it is introduced may preferably be chosen taking account of any increase in water content of the resin in the conductive member in a high temperature and high humidity environment.

More specifically, the ethylene oxide structure in the cationic group-immobilized electrically conducting resin may preferably be in a content of 30% by mass or less. Inasmuch as it is in a content of 30% by mass or less, the electrically conducting layer can more effectively be kept from decreasing in electrical resistance in excess in a high temperature and high humidity environment.

The cationic group-immobilized electrically conducting resin according to the present invention, having at least one structure of the structures represented by the formulas (1) to (3), may be produced by, e.g., the following method, using the following (1) reactive group-containing quaternary ammonium salt and (2) binder resin raw materials.

(1) Reactive Group-Containing Quaternary Ammonium Salt:

The reactive group-containing quaternary ammonium salt is an ammonium salt having the structure coming from hydrazine and the quaternary ammonium salt structure, and an ammonium salt represented by the following formula (9) may be used, for example. The structural moiety coming from hydrazine reacts with a functional group such as an epoxy group, a keto group or a formyl group to form a chemical bond. Here, upon reaction of this reactive group-containing quaternary ammonium salt with the keto group or formyl group, the structure represented by the formula (1) can be formed. Also, upon reaction of the reactive group-containing quaternary ammonium salt with one epoxy group, the structure represented by the formula (2) can be formed and, upon reaction with two epoxy groups, the structure represented by the formula (3) can be formed.

Incidentally, the anion in this reactive group-containing quaternary ammonium salt may be converted into any desired anion by ion exchange reaction.

Formula (9)

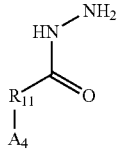

In the formula (9), $R_{11}$ represents an alkylene group having 1 to 10 carbon atom(s), $A_4$ represents a structure selected from the group consisting of structures respectively represented by the above formulas (4) to (7). Here, the alkylene group having 1 to 10 carbon atom(s) may be either of branched-chain and straight-chain.

The reactive group-containing quaternary ammonium salt may be produced by, e.g., the following method, using the following (a) quaternizing agent, (b) tertiary amine, (c) hydrazine and optionally (d) anion exchange salt.

(a) Quaternizing Agent:

The quaternizing agent may include, e.g., compounds having an ester group and having any one functional group selected from halogen groups such as fluorine, chlorine, bromine and iodine, a tosyl group (p-toluenesulfonyl group) and a methyl group (methanesulfonyl group). Stated specifically, it may include ethyl chloroacetate and ethyl 3-chloropropionate.

(b) Tertiary Amine:

The tertiary amine may include, e.g., aliphatic tertiary amines such as trimethylamine and triethylamine, and amines having a cyclic structure. The cyclic structure may include, e.g., aromatic rings such as a benzene ring and alicyclic hydrocarbons such as a cyclohexane ring. The amines having a cyclic structure may specifically include cyclic amines such as 1-methylpyrrolidine, 1-methylpiperidine and 1-methylmorpholine; and aromatic amine compounds such as imidazole and pyridine.

(c) Hydrazine ($H_2NNH_2$).

(d) Anion Exchange Salt:

The anion exchange salt may be used where the anion in a quaternary ammonium salt synthesized from the above quaternizing agent and tertiary amine is changed into other anion. For example, where the anion is changed into a perchlorate ion, lithium perchlorate may be used as the anion exchange salt. Also, where the anion is changed into a perfluorosulfonyl imide ion, lithium perfluorosulfonyl imide may be used as the anion exchange salt.

How to Synthesize Reactive Group-Containing Quaternary Ammonium Salt:

First, the above tertiary amine and quaternizing agent are allowed to react with each other to synthesize a quaternary ammonium salt. The reaction may be carried out without any solvent, or may be carried out in a solvent. As the solvent, it is preferable from the viewpoint of reactivity to use an alcohol solvent such as ethanol or isopropyl alcohol, a halogenous solvent such as chloroform or dichloromethane, or a polar solvent such as acetonitrile.

Then, the quaternary ammonium salt obtained is dissolved in a solvent (e.g., acetonitrile), followed by addition of hydrazine, thus the reactive group-containing quaternary ammonium salt represented by the formula (9) can be produced, for example. Where the anion in this reactive group-containing quaternary ammonium salt is changed, the reactive group-containing quaternary ammonium salt synthesized and the anion exchange salt may be added to a solvent (e.g., methanol/acetonitrile mixed solvent), followed by stirring, thereby changing the anion.

Incidentally, a reactive group-containing quaternary ammonium salt in which $R_{11}$ in the formula (9) is a methylene group and $A_4$ is a trimethyl ammonium salt represented by the following formula (10) is commercially available as Girard's Reagent T. Also, a reactive group-containing quaternary ammonium salt in which $R_{11}$ in the formula (9) is a methylene group and $A_4$ is a pyridinium salt represented by the following formula (11) is commercially available as Girard's Reagent P.

Formula (10)

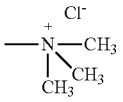

Formula (11)

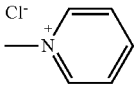

(2) Binder Resin Raw Materials:

The binder resin raw materials used in producing the cationic group-immobilized electrically conducting resin have at least one of an epoxy group, a keto group and a formyl group, which reacts with the structural moiety coming from hydrazine that is contained in the reactive group-containing quaternary ammonium salt. There are no particular limitations thereon except for having any of these groups, and usable are, e.g., resins such as epoxy resin, carbonyl group-containing polyvinyl alcohol, urethane resin having at least one of a keto group and a formyl group, and polyether ketone; rubbers such as epoxidized natural rubber, epoxidized butadiene rubber, and epoxy group-containing acrylic rubber; and epoxidized thermoplastic elastomers.

The reactive group-containing quaternary ammonium salt described above and the binder resin raw materials may be allowed to react with each other to produce the cationic group-immobilized electrically conducting resin used in the present invention. Also, the binder resin raw materials described above and other ion conducting resin such as polyethylene oxide or polypropylene oxide, an epichlorohydrin homopolymer, an epichlorohydrin-ethylene oxide copolymer, an epichlorohydrin-ethylene oxide-allylglycidyl ether terpolymer, an acrylonitrile-butadiene copolymer, a hydrogenated product of acrylonitrile-butadiene copolymer or a polar rubber such as urethane rubber may be used in the form of a mixture.

The reactive group-containing quaternary ammonium salt used in forming the cationic group-immobilized electrically conducting resin may be added in an amount set appropriately. It, however, is preferable to mix the reactive group-containing quaternary ammonium salt in a proportion of from 0.5 part by mass or more to 20 parts by mass or less, based on 100 parts by mass of the binder resin raw materials having at least one of an epoxy group, a keto group and a formyl group. Inasmuch as the reactive group-containing quaternary ammonium salt is mixed in an amount of 0.5 part by mass or more, the effect of providing the electrically conducting layer with conductivity in virtue of the addition of the electrically conducting agent can be obtained with ease. Inasmuch as it is in an amount of 20 parts by mass or less, the electrically conducting layer can easily be made to have less environmental dependence of its electrical resistance.

Other Components:

To the electrically conducting layer used in the present invention, a filler, a softening agent, a processing aid, a tackifier, a detackifier, a dispersant, a foaming agent and so forth which are commonly used as compounding agents for resins may be added as long as the effect of the present invention is not damaged.

Other Layers

Where the electrically conducting layer containing the cationic group-immobilized electrically conducting resin is used as a surface layer of the conductive member, any layer formed between the electrically conducting substrate and the surface layer (e.g., the elastic layer 12 or intermediate layer 14 shown in FIG. 1B or 1C) may be prepared with use of a rubber component, and various additives may also optionally be used therein. There are no particular limitations on the rubber component that forms these layers (the elastic layer and the intermediate layer), and any rubber may be used which is known in the field of the conductive member for electrophotography. Stated specifically, it may include an epichlorohydrin homopolymer, an epichlorohydrin-ethylene oxide copolymer, an epichlorohydrin-ethylene oxide-allylglycidyl ether terpolymer, an acrylonitrile-butadiene copolymer, a hydrogenated product of acrylonitrile-butadiene copolymer, silicone rubber, acrylic rubber, and urethane rubber.

Where the electrically conducting layer containing the cationic group-immobilized electrically conducting resin is used as a layer provided between the electrically conducting substrate and the surface layer (e.g., the elastic layer 12 or the intermediate layer 14) in the conductive member, the surface layer 13 may be prepared with use of a resin which is known in the field of the conductive member for electrophotography. Stated specifically, it may include acrylic resin, polyurethane, polyamide, polyester, polyolefin, and silicone resin. In forming such a surface layer, it is allowed to optionally also use carbon black, graphite, and an oxide having conductivity such as tin oxide, as well as a metal such as copper or silver, conductive particles the particle surfaces of which are coated with a metal so as to be provided with conductivity, and an ion conducting agent having ion exchange performance such as a quaternary ammonium salt.

Further, among the layers provided between the electrically conducting substrate and the surface layer, any layer other than the electrically conducting layer containing the cationic group-immobilized electrically conducting resin may be prepared in the following way. That is, it may be prepared with use of the rubber component described above that is usable in the elastic layer or intermediate layer when the electrically conducting layer containing the cationic group-immobilized electrically conducting resin is used as the surface layer, and various additives may further be used.

Process Cartridge

The process cartridge of the present invention is a process cartridge usable in electrophotographic image forming apparatus (process cartridge for electrophotography), and is so set up as to be detachably mountable (freely attached and detached) to the main body of an electrophotographic image forming apparatus. Also, this process cartridge has at least the conductive member for electrophotography of the present invention as any of, e.g., a charging member and a developing member.

Figure 2:
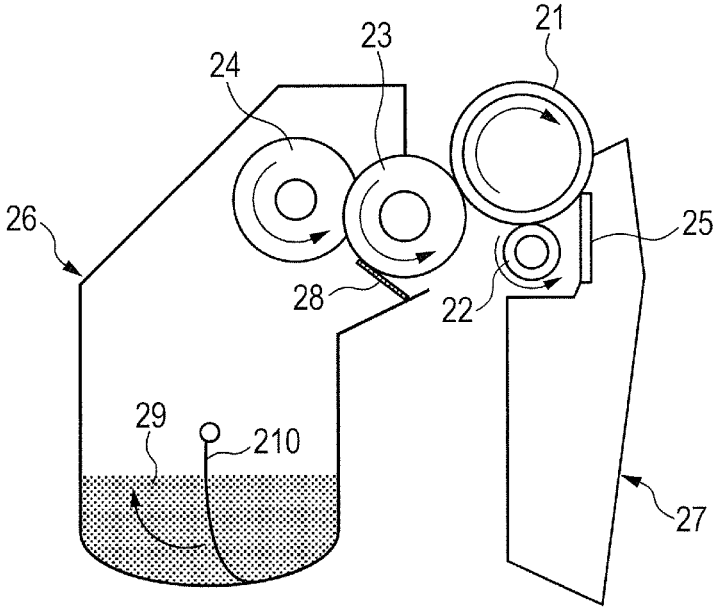
FIG. 2 is a view to illustrate the process cartridge according to the present invention.

The process cartridge of the present invention may have either or both of a developing assembly and a charging assembly. A schematic sectional view of an example of the process cartridge of the present invention is presented in FIG. 2. The developing assembly is what has a developing roller 23 and a toner container (developer container) 26 which are integrally joined, and may optionally have a toner feed roller 24, a toner 29, a developing blade 28 and an agitating blade 210.

The charging assembly is a part of what has at least an image bearing member photosensitive drum 21, a cleaning blade 25 and a charging roller 22 which are integrally joined, and what may have a waste toner container 27; the charging roller being in contact with the image bearing member and charging the image bearing member electrostatically with application of a voltage. The charging roller 22, the developing roller 23, the toner feed roller 24 and the developing blade 28 are each so designed that a voltage is applicable thereto. The conductive member of the present invention may preferably be used as the charging roller 22.

Electrophotographic Image Forming Apparatus

The electrophotographic image forming apparatus (electrophotographic apparatus) of the present invention has the conductive member of the present invention, having been described above, as any of, e.g., a charging member, a developing member and a transfer member.

Figure 3:
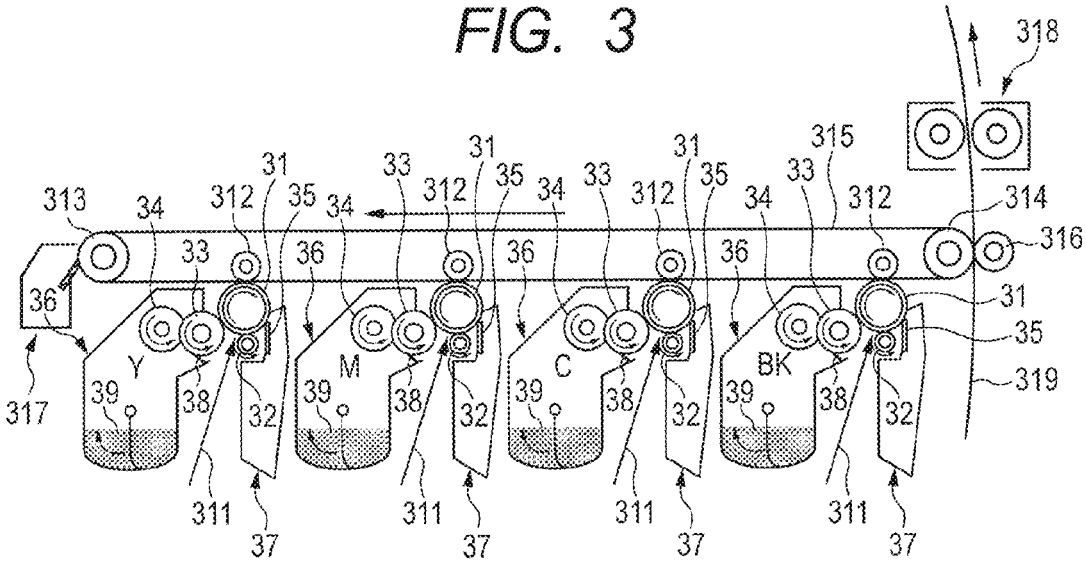
FIG. 3 is a view to illustrate the electrophotographic image forming apparatus according to the present invention.

A schematic sectional view of an example of the electrophotographic image forming apparatus of the present invention is presented in FIG. 3. This electrophotographic image forming apparatus may be provided with the process cartridge shown in FIG. 2, for each of black (BK), magenta (M), yellow (Y) and cyan (C) color toners. Such process cartridges are those which are so set up as to be detachably mountable to the main body of the electrophotographic image forming apparatus described above.

Photosensitive drums 31 are rotated in the directions of arrows, and are uniformly charged by means of charging rollers 32 to which voltages are kept applied from charging bias sources (not shown), and electrostatic latent images are formed on their surfaces by the aid of exposure light 311. Meanwhile, toners 39 held in toner containers 36 are fed to toner feed rollers 34 and are transported onto developing rollers 33. Then, the toners are uniformly coated on the surfaces of the developing rollers 33 by means of developing blades 38 disposed in contact with the developing rollers 33, and at the same time the toners 39 are provided with electric charges by triboelectric charging. The electrostatic latent images are developed by being provided with the toners 39 by means of the developing rollers 33 disposed in contact with the photosensitive drums 31, thereby being rendered visible as toner images.

The images rendered visible as toner images and held on the photosensitive drum are transferred to an intermediate transfer belt 315 by means of primary transfer rollers 312 to which voltages are kept applied from primary transfer bias sources (not shown); the intermediate transfer belt 315 being put over a tension roller 313 and an intermediate transfer belt drive roller (secondary transfer opposite roller) 314. Respective-color toner images are sequentially superimposed thereon, thus a full-color toner image is formed on the intermediate transfer belt.

A transfer material 319 is fed into the apparatus by a paper feed roller (not shown) and transported to the part between the intermediate transfer belt 315 and a secondary transfer roller 316. To the secondary transfer roller 316, a voltage is applied from a secondary transfer bias source (not shown), and the full-color toner image on the intermediate transfer belt 315 is transferred to the transfer material 319. The transfer material 319 to which the full-color toner image has been transferred is fixing-processed by means of a fixing assembly 318, and then put out of the apparatus, thus the operation of printing is completed. Meanwhile, toners remaining on the photosensitive drums without being transferred therefrom are removed by scraping the surfaces of the photosensitive drums with cleaning blades 35, and received into waste toner containers 37. The photosensitive drums 31 thus cleaned are put to the above steps repeatedly. Toners remaining on the intermediate transfer belt without being transferred therefrom are also scraped off by means of a cleaning unit (intermediate transfer belt cleaner) 317.

EXAMPLES

Examples of the present invention are given below.

Production of Charging Roller

Example 1

Production of Conductive Elastic Roller

Materials the kinds and amounts of which are shown in Table 1 below were mixed by means of a pressure kneader.

TABLE 1

| Materials | Amount; part(s) by mass |
|---|---|
| Nitrile-butadiene rubber (NBR) (trade name: NIPOL DN219; available from Nippon Zeon Co., Ltd.) | 100 |
| Carbon black (trade name: TOKA BLACK #7360SB; available from Tokai Carbon Co., Ltd.) | 40 |
| Calcium carbonate as filler (trade name: NANOX #30; available from Maruo Calcium Co., Ltd.) | 30 |
| Zinc oxide as vulcanization accelerator (Zinc Oxide Type II, available from Seido Chemical Industry Co.) | 5 |
| Zinc stearate as processing aid | 1 |

Thereafter, into the mixture obtained, materials shown in Table 2 below were mixed by means of an open roll to prepare an unvulcanized rubber composition I.

TABLE 2

| Materials | Part(s) by mass |
|---|---|
| Dibenzothiazolyl disulfide (trade name: NOCCELLER DM-P (available from | 1 |

TABLE 2-continued

| Materials | Part(s) by mass |
|---|---|
| Ohuchi-Shinko Chemical Industrial Co., Ltd.) | |
| Tetrabenzylthiuram disulfide (trade name: TBzTD; available from Sanshin Chemical Industry Co., Ltd.) | 3 |
| Sulfur | 1.2 |

A round rod of 252 mm in whole length and 6 mm in outer diameter was readied which was made of free-cutting steel and treated by electroless nickel plating on its surface. Next, an adhesive was coated on this round rod over the whole peripheral surface in the range of 230 mm, excluding its both end portions by 11 mm each. As the adhesive, a conductive vulcanizing adhesive (trade name: METALOC U-20; available from Toyokagaku Kenkyusho Co., Ltd.) was used. Also, a roll coater was used in its coating. In Example 1, the round rod thus coated with the adhesive was used as the electrically conducting substrate.

Next, a crosshead extruder having an electrically conducting substrate feed mechanism and an unvulcanized rubber roller discharge mechanism was readied, and a die of 12.5 mm in inner diameter was attached to the crosshead, where the extruder and the crosshead were set at 80° C. and conductive substrate transport speed was regulated to 60 mm/sec. Under these conditions, the unvulcanized rubber composition I was so fed from the extruder as to cover the electrically conducting substrate with the unvulcanized rubber composition I inside the crosshead to form an elastic layer (base layer) on the former to obtain an unvulcanized rubber roller.

Next, the above unvulcanized rubber roller was introduced into a 170° C. hot-air vulcanizing oven, and heated therein for 60 minutes to obtain an unsanded conductive elastic roller. Thereafter, end portions of the elastic layer were cut and removed. Finally, the surface of the elastic layer was sanded with a rotary grinding wheel. Thus, a conductive elastic roller was obtained which was 8.4 mm in diameter at each position of 90 mm from the middle thereof to both end portions and 8.5 mm in diameter at the middle.

Synthesis of Reactive Group-Containing Quaternary Ammonium Salt 1

1.23 g (10 mmol) of ethyl chloroacetate as a quaternizing agent was dissolved in 10 ml of dehydrated ethanol, and thereafter, to the solution obtained, 2.37 g (10 mmol) of a trimethylamine 25% by mass methanol solution as a tertiary amine was dropwise added at room temperature. The mixture solution obtained was stirred at room temperature for 12 hours, and thereafter heated and refluxed for 24 hours. After cooling to room temperature, the solvent was evaporated off under reduced pressure. The condensation product obtained was washed with 10 ml of hexane, and the supernatant liquid formed was removed by decantation. This operation was repeated twice, and thereafter the product obtained was dried under reduced pressure, and then dissolved in 10 ml of dehydrated ethanol. To the solution obtained, 0.60 g (12 mmol) of a hydrazine monohydrate was dropwise added, followed by stirring for 24 hours. Thereafter, the solvent was evaporated off under reduced pressure to obtain a residue.

The residue obtained was dissolved and suspended in a mixed solvent of 5 ml of dehydrated methanol and 5 ml of acetonitrile, followed by addition of 2.87 g (10 mmol) of lithium bis(trifluoromethanesulfonyl) imide as an anion exchange salt and then stirring for 24 hours. Thereafter, the solvent was evaporated off under reduced pressure. The residue obtained was extracted with 10 ml of acetonitrile, followed by filtration. The acetonitrile in the filtrate obtained was evaporated off under reduced pressure to obtain a reactive group-containing quaternary ammonium salt 1, the anion of which was a bis(trifluoromethanesulfonyl) imide ion.

Ion Conducting Layer:

—Preparation of Coating Solution

Materials shown in Table 3 below were mixed, and the mixture obtained was so diluted with isopropyl alcohol (IPA) as to be 27% by mass in solid content to prepare a coating solution 1.

TABLE 3

| Materials | Amount (g) |
|---|---|
| Polyethylene glycol diglycidyl ether (trade name: DENACOL EX-841; available from Nagase ChemteX Corporation) | 10.30 |
| Polypropylene glycol diglycidyl ether (trade name: DENACOL EX-931; available from Nagase ChemteX Corporation) | 7.37 |
| Ethylene glycol bis(aminoethyl) ether (available from Sigma-Aldrich Corporation) | 2.21 |
| Above reactive group-containing quaternary ammonium salt 1 | 0.40 |

Then, coating was performed in the following way. The coating solution 1 was put into a closed container, and this closed container was connected to a syringe pump, a solution feed means, which was further connected to a one-port solution feed opening provided in a ring coating head, where the coating solution 1 was fed in an appropriate quantity into the ring coating head. The coating solution 1 was filled in the ring coating head, having a solution distribution chamber where the solution meets inside the ring coating head so as to be distributed in the peripheral direction.

The above conductive elastic roller was so supported as to stand vertical, by means of members with which the conductive elastic roller was retained. The ring coating head was disposed in such a way that its slit-like ejection opening kept opened along the whole inner periphery was put around this conductive elastic roller at a distance forming a space of 0.5 mm with respect to the latter's outer diameter. At this point, the ring coating head ring was used in an opening width (slit width) of 0.1 mm for its slit-like ejection opening kept opened along the whole inner periphery. The ring coating head was disposed at the upper-side member with which the conductive elastic roller was retained; being disposed at a position of 20 mm from the upper end of the elastic layer of the conductive elastic roller.

Then, the coating was performed continuously from the upper-side member with which the conductive elastic roller was retained, on the surface of the conductive elastic roller and up to the lower-side member with which the conductive elastic roller was retained. As coating conditions, the coating solution 1 was coated at a constant rate of 50 mm/sec and at the same time in an appropriate quantity (0.07 ml) and at an ejection rate of 0.013 ml/sec uniformly over the whole roller periphery. Thereafter, the coat formed was air-dried at 23° C. for 30 minutes or more, then dried for 1 hour by means of a circulating hot-air drier set at 80° C., and further dried for 3 hours by means of a circulating hot-air drier set at 160° C., thus an ion conducting layer containing the cationic group-immobilized electrically conducting resin was formed on the peripheral surface of the conductive elastic roller. This ion conducting layer was in a thickness of 10 μm. In this way, a conductive roller of Example 1 was obtained.

Characteristics Evaluation

Next, this conductive roller was put to the following evaluation tests.

Evaluation 1: Measurement of Electrical Resistivity of Ion Conducting Layer.

The electrical resistivity (film resistivity) of the ion conducting layer was calculated by measuring alternating-current impedance by four-terminal probing. The measurement was made at a voltage amplitude of 5 mV and a frequency of from 1 Hz to 1 MHz.

Where the conductive roller produced had a plurality of conduction layers, an electrically conducting layer (an electrically conducting layer not containing any cationic group-immobilized electrically conducting resin) present on the periphery outside the electrically conducting layer containing the cationic group-immobilized electrically conducting resin was peeled away, and the electrical resistivity of the electrically conducting layer satisfying the requirement of the present invention was measured.

The electrical resistivity was measured in each of an environment of temperature 15° C. and humidity 10% RH (relative humidity), i.e., an L/L environment, and an environment of temperature 30° C. and humidity 80% RH, i.e., an H/H environment. In order to ascertain any influence of environmental variations, the logarithm ($\log_{10}$) of the ratio of electrical resistivity in the L/L environment to electrical resistivity in the H/H environment [electrical resistivity (L/L)/electrical resistivity (H/H)] was taken, and was noted as an environmental variation figure. Here, in Example 1, the conductive roller produced was left to stand for 48 hours or more in the environment where the electrical resistivity was measured, and thereafter the electrical resistivity of its ion conducting layer was evaluated. The results of evaluation are shown in Table 22.

Incidentally, what is meant by, e.g., "3.23E+06" (Ω·cm) for the film resistivity (L/L) of the ion conducting layer of Example 1 shown in Table 22 is $3.23\times10^{6}$ (Ω·cm).

Evaluation 2: Measurement of Electrical Resistivity of Base Layer.

The electrical resistivity (base layer resistivity) of the base layer (elastic layer) was measured in the L/L environment and the H/H environment each, in the same way as the measurement of electrical resistivity of the ion conducting layer. Incidentally, on that occasion, the layers present on the periphery outside the base layer were all peeled away, and the electrical resistivity of the base layer was measured. The results of evaluation are shown in Table 22.

Evaluation 3: Bleeding Test.

A bleeding test as shown below was conducted. Stated specifically, the conductive roller was incorporated as a charging roller into a process cartridge for an electrophotographic laser beam printer (trade name: LASERJET CP4525dn; manufactured by Hewlett-Packard Company). Next, the process cartridge was left to stand for 2 weeks in an environment of temperature 40° C. and humidity 95% RH, and then the surface of the photosensitive drum was observed on an optical microscope (10 magnifications). Whether or not any bled matter from the charging roller adhered to the drum surface and whether or not the photosensitive drum surface cracked were observed to make evaluation according to the following criteria.

A: Any bled matter adhering and any cracks are not observed on the surface of roller contact area of the photosensitive drum.

B: Slight bled matter adhering is seen on some roller contact area surface, but any cracks are not observed.

C: Slight bled matter adhering is seen on the whole roller contact area surface, but any cracks are not observed.

D: Bled matter and cracks are observed on the roller contact area surface.

Image Evaluation

Next, the conductive roller produced was used as the charging roller, and put to the following evaluation tests.

Evaluation 4: Evaluation on Resistance Change with Time (Horizontal Lines).

Figure 4A:
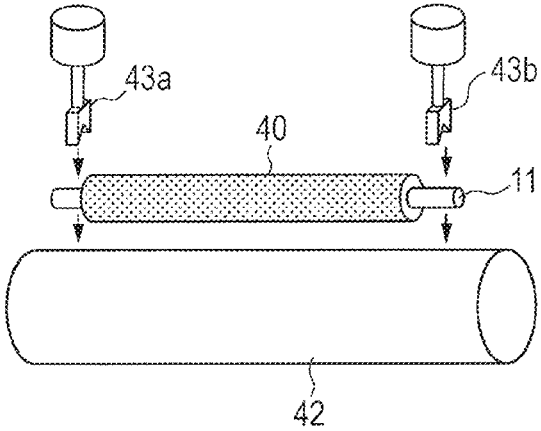
FIG. 4A is a view to illustrate a jig for resistance change with time, usable in making evaluation on the resistance change with time of the conductive member.
Figure 4B:
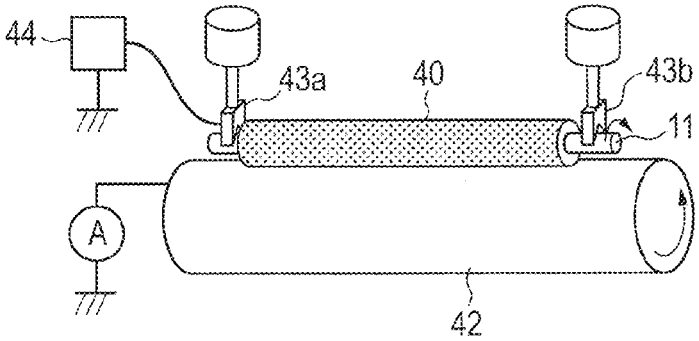
FIG. 4B is a view to illustrate the jig for resistance change with time, usable in making evaluation on the resistance change with time of the conductive member.

In order to ascertain the effect of keeping the electrical resistance value from deteriorating where the conductive roller of the present invention was used for a long term and the effect of lowering the electrical resistance value in the L/L environment, evaluation was made in the following way by using a jig for resistance change with time the construction of which is schematically shown in FIGS. 4A and 4B.

First, to make evaluation on the resistance change with time of the charging roller, the conductive roller produced was left to stand for 48 hours in an environment of temperature 15° C. and humidity 10% RH (L/L). Next, in this L/L environment, a stress that presses a conductive shaft member 11 of a conductive roller 40 vertically downward was applied to its both end portions through bearings 43*a* and 43*b* fastened to weights. Stated specifically, the conductive shaft member 11 was pressed downward at its both end portions with application of a load of 500 gf (4.9 N) for each end side to bring the conductive roller 40 into contact with a columnar metal 42 of 24 mm in diameter. Here, vertically downward to the conductive roller 40, the columnar metal 42 was disposed in parallel to the conductive roller 40. Then, in the L/L environment, a drive unit (not shown) was operated to rotate the columnar metal 42 at the same rotational speed as the photosensitive drum, stated specifically, at 30 rpm ($min^{-1}$), and at the same time a direct current of 200 μA was applied thereto by a power source 44 for 30 minutes. Thereafter, image evaluation was made in the following way.

As an electrophotographic image forming apparatus, an electrophotographic laser beam printer (trade name: LASERJET CP4525dn; manufactured by Hewlett-Packard Company) was readied which was converted into high-speed processing so as to reproduce images in a number of sheets of A4-size 50 sheets/minute. On that occasion, recording medium output speed was set at 300 mm/sec, and image resolution at 1,200 dpi. The above conductive roller was incorporated as a charging roller into a process cartridge of the above electrophotographic image forming apparatus, and images were reproduced to make image evaluation. The evaluation of images was made all in the L/L environment, and halftone (an image in which horizontal lines were each drawn in a width of 1 dot and at intervals of 2 dots in the direction perpendicular to the rotational direction of the photosensitive member) images were reproduced. The images obtained were evaluated according to the following criteria.

A: Any horizontal streaky images are not seen.

B: Slight horizontal streaky white lines are seen in some part.

C: Slight horizontal streaky white lines are seen over the whole area.

D: Serious horizontal streaky white lines are seen, and are conspicuous.

Evaluation 5: Evaluation on Alternating-Current Potential that can Cancel any Faulty Images Caused by Faulty Charging.

As an electrophotographic image forming apparatus, a laser beam printer (trade name: LASERJET 4515n; manufactured by Hewlett-Packard Company) was readied which had a charging roller disposed in contact with a drum-shaped electrophotographic photosensitive member and was so set up that an alternating voltage and a direct voltage were superimposedly applicable to the charging roller. Here, this laser beam printer had a recording medium output speed of 370 mm/sec and an image resolution of 1,200 dpi. Also, a charging roller holding member in the process cartridge of this electrophotographic image forming apparatus was changed for a holding member converted to have a length longer by 3.5 mm than the former holding member so that the conductive roller having an outer diameter of 8.5 mm could be incorporated.

Then, the conductive roller produced was incorporated as a charging roller into this laser beam printer to make evaluation on how any fine spotty faulty images appeared on electrophotographic images when conditions for alternating-voltage application were changed.

In the present invention, electrophotographic images on which such fine spots have appeared are called "sandy images". The "sandy images" may appear because of non-uniform charging of the electrophotographic photosensitive member surface by the charging roller. Then, applying to the charging roller the alternating voltage superimposedly in addition to the direct voltage brings the effect of making uniform the state of charging of the surface of the electrophotographic photosensitive member, to keep the sandy images from occurring. Then, such an effect is more improved as the higher the potential of the alternating voltage to be applied is made. Therefore, it follows that the basic performance of the charging roller is excellent if the "sandy images" do not appear even when the alternating voltage applied is low.

Accordingly, in the present evaluation, it was intended that, the alternating voltage applied to the charging roller was stepwise raised on, and the alternating-current potential at which the "sandy images" came to no longer appear was observed, thereby evaluating the basic performance of the charging roller.

Stated specifically, in a low temperature and low humidity environment (temperature: 15° C. and humidity: 10% RH), the alternating voltage and the direct voltage were superimposedly applied to the charging roller, and halftone images were reproduced. Herein, as the halftone images, an image was used in which horizontal lines were each drawn in a width of 1 dot and at intervals of 2 dots in the direction perpendicular to the rotational direction of the electrophotographic photosensitive member. Here, the alternating voltage applied to the charging roller was made to change, and the lowest applied alternating voltage was measured at which the spots on electrophotographic images disappeared.

More specifically, first, a direct voltage of −600 V and an alternating voltage Vpp of 2,931 Hz in frequency and 1,200 V were applied, where electrophotographic images were formed to ascertain the presence of any spots on the electrophotographic images obtained. Subsequently, the alternating voltage was raised by 10 V, where electrophotographic images were again reproduced to likewise ascertain the presence of any spots on the electrophotographic images obtained. Then, in the same way, the alternating voltage was raised by 10 V at intervals of 10 V, where electrophotographic images were formed to observe the electrophotographic images obtained, and this operation was repeated until electrophotographic images on which the spots disappeared were obtained. Then, the applied alternating voltage at which the spots disappeared from electrophotographic images was regarded as sand disappearing voltage.

Examples 2 to 35

Conductive rollers of Examples 2 to 35 were produced in the same way as Example 1 except that the coating solution for the ion conducting layer was changed for coating solutions shown in Table 4, respectively. Then, the above evaluation was made in the same way as Example 1. The results of evaluation are shown in Tables 22 to 25.

Structures of reactive group-containing quaternary ammonium salts 1 to 29 and materials used to produce these slats, as used in preparing coating solutions 1 to 35 shown in Table 4, are shown in Table 5, and binder resin raw materials also used therein are shown in Table 6. In Table 4, also shown are the amount of each reactive group-containing quaternary ammonium salt added, used to form the ion conducting layers, and the content of each ethylene oxide structure (EO content) in the ion conducting layers (cationic group-immobilized electrically conducting resins).

The amount (part by mass, pbm) of each reactive functional group-containing quaternary ammonium salt added, shown Table 4, refers to part(s) by mass used when the solid content in the coating solution is given as 100 parts by mass. The EO content was calculated from the binder resin raw materials used.

In Tables, the reactive group-containing quaternary ammonium salt presents the structure represented by the formula (9). Also, in Table 5, TFSI refers to bis(trifluoromethanesulfonyl imide ion; and NFSI, bis(nonafluorobutanesulfonyl) imide ion. Also, Me stands for a methyl group; Et, an ethyl group; n-Pr, a n-propyl group; Allyl, an allyl group; and Bu, a butyl group. In Table 5, what has no entry on the anion exchange salt shows that no ion exchange is effected.

The quaternizing agents A to H, tertiary amines A to O and anion exchange salts A to C entered in this Table 5 are shown in Tables 7 to 9, respectively. Here, in Examples 2 to 35, the coating solutions were prepared in the same way as Example 1 except that these materials were used.

TABLE 4

| Example: | Coating solution | Reactive group = containing quaternary ammonium salt | | Binder resin raw materials | | EO content |
|---|---|---|---|---|---|---|
| | | Type | Amount (pbm) | Types | Amount (pbm ratio) | (mass %) |
| 1 | 1 | 1 | 2 | A/B/D | 52/37/11 | 30 |
| 2 | 2 | 2 | 2 | A/B/D | 52/37/11 | 30 |
| 3 | 3 | 3 | 2 | A/B/D | 52/37/11 | 30 |
| 4 | 4 | 4 | 2 | A/B/D | 52/37/11 | 30 |
| 5 | 5 | 5 | 2 | A/B/D | 52/37/11 | 30 |
| 6 | 6 | 6 | 2 | A/B/D | 52/37/11 | 30 |
| 7 | 7 | 7 | 2 | A/B/D | 52/37/11 | 30 |
| 8 | 8 | 8 | 2 | A/B/D | 52/37/11 | 30 |
| 9 | 9 | 9 | 2 | A/B/D | 52/37/11 | 30 |
| 10 | 10 | 10 | 2 | A/B/D | 52/37/11 | 30 |
| 11 | 11 | 11 | 2 | A/B/D | 52/37/11 | 30 |
| 12 | 12 | 12 | 2 | A/B/D | 52/37/11 | 30 |
| 13 | 13 | 13 | 2 | A/B/D | 52/37/11 | 30 |
| 14 | 14 | 14 | 2 | A/B/D | 52/37/11 | 30 |
| 15 | 15 | 15 | 2 | A/B/D | 52/37/11 | 30 |
| 16 | 16 | 16 | 2 | A/B/D | 52/37/11 | 30 |
| 17 | 17 | 17 | 2 | A/B/D | 52/37/11 | 30 |
| 18 | 18 | 18 | 2 | A/B/D | 52/37/11 | 30 |
| 19 | 19 | 19 | 2 | A/B/D | 52/37/11 | 30 |
| 20 | 20 | 20 | 2 | A/B/D | 52/37/11 | 30 |
| 21 | 21 | 21 | 2 | A/B/D | 52/37/11 | 30 |
| 22 | 22 | 22 | 2 | A/B/D | 52/37/11 | 30 |
| 23 | 23 | 23 | 2 | A/B/D | 52/37/11 | 30 |
| 24 | 24 | 24 | 2 | A/B/D | 52/37/11 | 30 |

TABLE 4-continued

| Example: | Coating solution | Reactive group = containing quaternary ammonium salt: Type | Reactive group = containing quaternary ammonium salt: Amount (pbm) | Binder resin raw materials: Types | Binder resin raw materials: Amount (pbm ratio) | EO content (mass %) |
|---|---|---|---|---|---|---|
| 25 | 25 | 25 | 2 | A/B/D | 52/37/11 | 30 |
| 26 | 26 | 1 | 1 | A/B/D | 52/37/11 | 30 |
| 27 | 27 | 1 | 8 | A/B/D | 52/37/11 | 30 |
| 28 | 28 | 1 | 2 | B/E | 77/23 | 0 |
| 29 | 29 | 1 | 2 | A/B/D | 16/74/10 | 10 |
| 30 | 30 | 1 | 2 | A/B/D | 58/31/11 | 50 |

TABLE 4-continued

| Example: | Coating solution | Reactive group = containing quaternary ammonium salt: Type | Reactive group = containing quaternary ammonium salt: Amount (pbm) | Binder resin raw materials: Types | Binder resin raw materials: Amount (pbm ratio) | EO content (mass %) |
|---|---|---|---|---|---|---|
| 31 | 31 | 1 | 2 | A/C/D | 52/37/11 | 30 |
| 32 | 32 | 26 | 2 | A/B/D | 52/37/11 | 30 |
| 33 | 33 | 27 | 2 | A/B/D | 52/37/11 | 30 |
| 34 | 34 | 28 | 2 | A/B/D | 52/37/11 | 30 |
| 35 | 35 | 29 | 2 | A/B/D | 52/37/11 | 30 |

TABLE 5

| Reactive group-containing quaternary ammonium salt | | | | | | | |
|---|---|---|---|---|---|---|---|
| | | Structure | | | Materials | | |
| | | $A_4$ | | | | | Anion |
| Type | $R_{11}$ | Formula | R included in $A_4$ | Anion | Quaternizing agent | Tertiary amine | exchange salt |
| 1 | $CH_2$ | 4 | $R_4, R_5, R_6$ = Me | TFSI | A | A | A |
| 2 | $CH_2$ | 4 | $R_4, R_5, R_6$ = Et | TFSI | A | B | A |
| 3 | $CH_2$ | 4 | $R_4, R_5, R_6$ = n-Pr | TFSI | A | C | A |
| 4 | $CH_2$ | 4 | $R_4, R_5$ = Me, $R_6$ = octyl | TFSI | A | D | A |
| 5 | $CH_2$ | 4 | $R_4, R_5$ = Me, $R_6$ = tetradecyl | TFSI | A | E | A |
| 6 | $CH_2$ | 4 | $R_4, R_5, R_6$ $CH_2CH_2OCH_2CH_2OCH_3$ | TFSI | A | F | A |
| 7 | $CH_2$ | 5 | $R_7$ = Me, n = 1, X = $CH_2$ | TFSI | A | G | A |
| 8 | $CH_2$ | 5 | $R_7$ = Me, n = 2, X = $CH_2$ | TFSI | A | H | A |
| 9 | $CH_2$ | 5 | $R_7$ = Me, n = 2, X = O | TFSI | A | I | A |
| 10 | $CH_2$ | 6 | — | TFSI | A | J | A |
| 11 | $CH_2$ | 7 | $R_8$ = Me | TFSI | A | K | A |
| 12 | $CH_2$ | 7 | $R_8$ = Et | TFSI | A | L | A |
| 13 | $CH_2$ | 7 | $R_8$ = Pr | TFSI | A | M | A |
| 14 | $CH_2$ | 7 | $R_8$ = Allyl | TFSI | A | N | A |
| 15 | $CH_2$ | 7 | $R_8$ = Bu | TFSI | A | O | A |
| 16 | $(CH_2)_2$ | 4 | $R_4, R_5, R_6$ = Me | TFSI | B | A | A |
| 17 | $(CH_2)_2$ | 4 | $R_4, R_5$ = Me, $R_6$ = tetradecyl | TFSI | B | E | A |
| 18 | $(CH_2)_3$ | 4 | $R_4, R_5, R_6$ = Me | TFSI | C | A | A |
| 19 | $(CH_2)_3$ | 5 | $R_7$ = Me, n = 2, X = $CH_2$ | TFSI | C | H | A |
| 20 | $(CH_2)_6$ | 4 | $R_4, R_5, R_6$ = Me | TFSI | D | A | A |
| 21 | $(CH_2)_6$ | 6 | — | TFSI | D | J | A |
| 22 | $(CH_2)_{10}$ | 4 | $R_4, R_5, R_6$ = Me | TFSI | E | A | A |
| 23 | $(CH_2)_{10}$ | 7 | $R_8$ = Pr | TFSI | E | M | A |
| 24 | $CHCH_3$—$CH_2$—* | 4 | $R_4, R_5, R_6$ = Me | TFSI | F | A | A |
| 25 | $CHCH_3$—$CH_2$—$CH_2$—* | 4 | $R_4, R_5, R_6$ = Me | TFSI | G | A | A |
| 26 | $CH_2$ | 4 | $R_4, R_5, R_6$ = Me | Cl | A | A | — |
| 27 | $CH_2$ | 4 | $R_4, R_5, R_6$ = Me | Br | H | A | — |
| 28 | $CH_2$ | 4 | $R_4, R_5, R_6$ = Me | $ClO_4$ | A | A | B |
| 29 | $CH_2$ | 4 | $R_4, R_5, R_6$ = Me | NFSI | A | A | C |

Asterisk * in $R_{11}$ in types 24 and 25 represent the position of bonding with $A_4$

TABLE 6

| Type | Binder resin raw materials |
|---|---|
| A | Polyethylene glycol diglycidyl ether (trade name: DENACOL EX-841; available from Nagase ChemteX Corporation) |
| B | Polypropylene glycol diglycidyl ether (trade name: DENACOL EX-931; available from Nagase ChemteX Corporation) |
| C | Polybutylene glycol diglycidyl ether (trade name: EPOGOSEY PT; available from Yokkaichi Chemical Company Limited |
| D | Ethylene glycol bis(aminoethyl) ether (available from Sigma-Aldrich Corporation |
| E | Polypropylene glycol bis(2-aminopropyl) ether (available from Sigma-Aldrich Corporation |

TABLE 7

| Type | Quaternizing agent |
|---|---|
| A | Ethyl chloroacetate |
| B | Ethyl 3-chloropropionate |
| C | Ethyl 4-chlorobutyrate |
| D | Ethyl 7-bromoheptanoate |
| E | Ethyl 11-bromoundecanoate |
| F | Methyl 3-bromoisobutyrate |
| G | Methyl 4-chloro-2-methylbutyrate |
| H | Ethyl bromoacetate |

TABLE 8

| Type | Tertiary amine |
|---|---|
| A | Trimethylamine |
| B | Triethylamine |
| C | Tripropylamine |
| D | N,N-dimethyl-n-octylamine |
| E | N,N-dimethyltetradecylamine |
| F | Tris[2-(2-methoxyethoxy)ethyl]amine |
| G | 1-Methylpyrrolidine |
| H | 1-Methylpiperidine |
| I | 4-Methylmorphorine |
| J | Pyridine |
| K | 1-Methylimidazole |
| L | 1-Ethylimidazole |
| M | 1-Propylimidazole |
| N | 1-Allylimidazole |
| O | 1-Buylimidazole |

TABLE 9

| Type | Anion exchange salt |
|---|---|
| A | Lithium bis(trifluoromethanesulfonyl imide |
| B | Lithium perchlorate |
| C | Lithium bis(nonafluoro-1-butanesulfonyl) imide |

Examples 36 & 37

Conductive rollers were produced in the same way as Example 1 except that the layer thickness 10 μm of the ion conducting layer was changed to 2 μm and 20 μm, respectively. These were evaluated as charging rollers in the same way. The results of evaluation are shown in Table 25.

Examples 38 & 39

Conductive rollers were produced in the same way as Example 1 except that the amount 40 parts by mass of the carbon black used in the unvulcanized rubber composition I to form the elastic layer was changed to 50 parts by mass and 30 parts by mass, respectively, and were evaluated as charging rollers in the same way. The results of evaluation are shown in Table 25.

Example 40

Materials the kinds and amounts of which are shown in Table 10 below were mixed by means of a pressure kneader.

TABLE 10

| Materials | Amount; part(s) by mass |
|---|---|
| Hydrin rubber (trade name: EPION 301; available from Daiso Co., Ltd.) | 100 |
| Calcium carbonate as filler (trade name: NANOX #30; available from Maruo Calcium Co., Ltd.) | 60 |
| Zinc oxide as vulcanization accelerator (Zinc Oxide Type II, available from Seido Chemical Industry Co.) | 5 |
| MT carbon black as conduction agent (trade name: THERMAX FLOFORM N990; available from Cancab Technologies Ltd. | 5 |
| Polyester sebacate as plasticizer | 5 |
| Quaternary ammonium salt (trade name: ADECASIZER LV-70; available from ADEKA Corporation) | 2 |
| Zinc stearate as processing aid | 1 |

Into the mixture obtained, materials shown in Table 11 below were mixed by means of an open roll to obtain an unvulcanized rubber composition II.

TABLE 11

| Materials | Part(s) by mass |
|---|---|
| Dibenzothiazolyl disulfide (trade name: NOCCELLER DM-P (available from Ohuchi-Shinko Chemical Industrial Co., Ltd.) | 1 |
| Tetramethylthiuram monosulfide (trade name: NOCCELLER TS (available from Ohuchi-Shinko Chemical Industrial Co., Ltd.) | 1 |
| Sulfur | 1 |

A conductive roller was produced in the same way as Example 1 except that this unvulcanized rubber composition II was used in place of the unvulcanized rubber composition I. This was evaluated as a charging roller in the same way. The results of evaluation are shown in Table 25.

Example 41

On the conductive roller produced in Example 1, a protective layer was formed in the following way.

First, to a caprolactone modified acrylic polyol solution, methyl isobutyl ketone (MIBK) was added to control the former's solid content so as to be 18% by mass. Using materials shown in Table 12 below, including 555.6 parts by mass (solid content: 100 parts by mass) of this MIBK-containing caprolactone modified acrylic polyol solution, a mixture solution was prepared. At this point, a mixture of the blocked HDI and the blocked IPDI was so added as to be "NCO/OH=1.0".

TABLE 12

| Materials | Part(s) by mass |
|---|---|
| Caprolactone modified acrylic polyol (trade name: PLACCEL DC2016; available from Daicel Chemical Industries, Ltd.) | 100 (solid content) |
| Carbon black (HAF) | 16 |
| Acicular rutile type fine titanium oxide particles (having been surface-treated with hexamethyldisilazane and dimethylsilicone; average particle diameter: 0.015 μm; length/breadth = 3:1 | 35 |
| Modified dimethylsilicone oil (trade name: SH-28PA; available from Dow Corning Toray Silicone Co., Ltd.) | 0.1 |
| 7:3 mixture of hexamethylene diisocyanate (HDI) and isophorone diisocyanate (IPDI) each blocked with butanone oxime | 80.14 |

Next, 210 g of this mixture solution and 200 g of glass beads of 0.8 mm in volume-average particle diameter as dispersion media were mixed in a 450 ml glass bottle, followed by dispersion for 24 hours by using a paint shaker dispersion machine. After the dispersion was completed, cross-linked type acrylic particles "MR50G" (trade name; available from Soken Chemical & Engineering Co., Ltd.) as resin particles were added in an amount of 5.44 parts by mass (corresponding to 20 parts by mass based on 100 parts by mass of the acrylic polyol), followed by further dispersion for 30 minutes to obtain a protective layer coating fluid.

The same conductive roller as that produced in Example 1 was coated with this protective layer coating fluid by one-time dipping. Then, the coat formed was air-dried at normal temperature for 30 minutes or more, then dried for 1 hour by means of a circulating hot-air drier set at 90° C., and further dried for 1 hour by means of a circulating hot-air drier set at 160° C., thus a protective layer was formed on the electrically conducting layer. The dip-coating was so controlled as for dipping time to be 9 seconds, and for dipping draw-up speed to be 20 mm/sec in initial-stage speed and 2 mm/sec in final speed, and the speed of from 20 mm/sec to 2 mm/sec was changed linearly with respect to time. Thus, a conductive roller of Example 41 was obtained, and was evaluated as a charging roller. The results of evaluation are shown in Table 26.

Example 42

Materials shown in Table 13 below were mixed to prepare a solution. Here, in the solution prepared, the ethylene oxide content in the cationic group-immobilized electrically conducting resin was 30% by mass.

TABLE 13

| Materials | Amount (g) |
|---|---|
| Polyethylene glycol diglycidyl ether (trade name: DENACOL EX-841; available from Nagase ChemteX Corporation) | 10.30 |
| Polypropylene glycol diglycidyl ether (trade name: DENACOL EX-931; available from Nagase ChemteX Corporation) | 7.37 |
| Ethylene glycol bis(aminoethyl) ether (available from Sigma-Aldrich Corporation | 2.21 |
| Above reactive group-containing quaternary ammonium salt 1 | 0.40 |

Next, the solution prepared was casted into a cavity formed in a mold in which an electrically conducting substrate was kept disposed. Subsequently, this mold was heated at 80° C. for 1 hour and at 160° C. for 3 hours to effect heat curing, which was then cooled and thereafter demolded to obtain a conductive elastic roller the surface of the electrically conducting substrate of which was covered with an electrically conducting layer. The electrically conducting layer was in a thickness of 1,250 μm. Here, as the electrically conducting substrate, the same one as that in Example 1 was used. Thereafter, end portions of the electrically conducting layer was so cut and removed that the electrically conducting layer had a length of 228 mm. Thus, a conductive roller of Example 42 was produced, and was evaluated as a charging roller. The results of evaluation are shown in Table 26.

Example 43

A conductive roller of Example 43 was produced in the same way as Example 1 except that the coating solution used in preparing the ion conducting layer of the conductive roller was changed from the coating solution 1 to the following coating solution 36 and that the layer thickness of the ion conducting layer was changed to 5 μm. The conductive roller obtained was evaluated as a charging roller in the same way. The formulation of the coating solution is shown in Table 15, and the results of evaluation are shown in Table 26.

—Preparation of Coating Solution 36

Materials shown in Table 14 below were mixed, and the mixture obtained, and mixture obtained was so diluted with dimethyl formamide as to be 27% by mass in solid content to prepare a coating solution 36.

TABLE 14

| Materials | Amount (g) |
|---|---|
| Epoxidized natural rubber (trade name: EPOXYPRENE 50; available from Muang Mai Guthrie Public Company Limited) | 9.00 |
| Hydrin rubber (trade name: EPION 301; available from Daiso Co., Ltd.) | 10.60 |
| Dicumyl peroxide (trade name: PERCUMYL D-40B; available from NOF Corporation) | 0.40 |
| Above reactive group-containing quaternary ammonium salt 1 | 0.40 |

Examples 44 to 50

Conductive rollers of Examples 44 to 50 were produced in the same way as Example 1 except that the coating solution used in preparing the ion conducting layer was changed for coating solutions shown in Table 15 and that the layer thickness of the ion conducting layer was changed to thicknesses shown in Table 26. The conductive rollers obtained were evaluated as charging rollers in the same way. Binder resin raw materials F to K marked in Table 15 are shown in Table 16, and the results of evaluation are shown in Table 26.

TABLE 15

| | | Example | | | | | | | |
|---|---|---|---|---|---|---|---|---|---|
| | | 43 | 44 | 45 | 46 | 47 | 48 | 49 | 50 |
| | | Coating solution | | | | | | | |
| | | 36 | 37 | 38 | 39 | 40 | 41 | 42 | 43 |
| Reactive group = containing quaternary ammonium salt | Type: | 1 | 3 | 1 | 17 | 1 | 19 | 1 | 21 |
| | Amount (pbm) | 2 | 2 | 2 | 2 | 2 | 2 | 2 | 2 |
| Binder resin raw materials | Types: | F/J/K | F/J/K | G/J/K | G/J/K | H/J/K | H/J/K | I/J/K | I/J/K |
| | Amount (pbm ratio) | 45/53/2 | 45/53/2 | 45/53/2 | 45/53/2 | 45/53/2 | 45/53/2 | 45/53/2 | 45/53/2 |
| EO content (% by mass) | | 30 | 30 | 30 | 30 | 30 | 30 | 30 | 30 |

TABLE 16

| Type | Binder resin raw materials |
|---|---|
| F | Epoxidized natural rubber (trade name: EPOXYPRENE 50; available from Muang Mai Guthrie Public Company Limited) |
| G | Epoxidized butadiene rubber (trade name: EPOLEAD PB3600; available from Daicel Chemical Industries, Ltd.) |
| H | Epoxy group-containing acrylic rubber (trade name: NIPOL AR54; available from Nippon Zeon Co., Ltd.) |
| I | Epoxidized thermoplastic elastomer (trade name: EPOFRIEND AT501; available from Daicel Chemical Industries, Ltd.) |
| J | Hydrin rubber (trade name: EPION 301; available from Daiso Co., Ltd.) |
| K | Dicumyl peroxide (trade name: PERCUMYL D-40B; available from NOF Corporation) |

Example 51

A conductive roller of Example 51 was produced in the same way as Example 1 except that the coating solution used in preparing the ion conducting layer of the conductive roller was changed from the coating solution 1 to the following coating solution 44. The conductive roller obtained was evaluated as a charging roller in the same way. The formulation of the coating solution is shown in Table 18, and the results of evaluation are shown in Table 27.

—Preparation of Coating Solution 44

Materials shown in Table 17 below were mixed, and the mixture obtained was so diluted with a solution of water and isopropyl alcohol in 1:1 as to be 27% by mass in solid content to prepare a coating solution 44 containing the cationic group-immobilized electrically conducting resin having the structure represented by the formula (1).

TABLE 17

| Materials | Amount (g) |
|---|---|
| Carbonyl modified polyvinyl alcohol (trade name: DF-20; available from Japan VAM & POVAL Co., Ltd. | 14.00 |
| Modified polyethylene oxide (trade name: AQUACOKE; available from | 6.00 |

TABLE 17-continued

| Materials | Amount (g) |
|---|---|
| Sumitomo Seika Chemicals Company Limited) | |
| Above reactive group-containing quaternary ammonium salt 1 | 0.40 |

Examples 52 to 54

Conductive rollers of Examples 52 to 54 were produced in the same way as Example 1 except that the coating solution used in preparing the ion conducting layer was changed for coating solutions shown in Table 18 and that the layer thickness of the ion conducting layer was changed to thicknesses shown in Table 27. The conductive rollers obtained were evaluated as charging rollers in the same way. Incidentally, the coating solutions 44 to 47 used in these Examples contain the cationic group-immobilized electrically conducting resin having the structure represented by the formula (1). Binder resin raw materials L to N marked in Table 18 are shown in Table 19, and the results of evaluation are shown in Table 27.

TABLE 18

| | | Example | | | |
|---|---|---|---|---|---|
| | | 51 | 52 | 53 | 54 |
| | | Coating solution | | | |
| | | 44 | 45 | 46 | 47 |
| Reactive group = containing quaternary ammonium salt | Type: | 1 | 23 | 1 | 25 |
| | Amount (pbm) | 2 | 2 | 2 | 2 |
| Binder resin raw materials | Types: | L/N | L/N | M/N | M/N |
| | Amount (pbm ratio) | 70/30 | 70/30 | 70/30 | 70/30 |
| EO content (% by mass) | | 30 | 30 | 30 | 30 |

TABLE 19

| Type | Binder resin raw materials |
|---|---|
| L | Carbonyl modified polyvinyl alcohol (trade name: DF-20; available from Japan VAM & POVAL Co., Ltd. |
| M | Carbonyl group-containing polyacrylic emulsion (trade name: CELUNA WE-518; available from Cyukyo Yushi Co., Ltd. |
| N | Modified polyethylene oxide (trade name: AQUACOKE; available from Sumitomo Seika Chemicals Company Limited) |

Example 55

A conductive roller of Example 55 was produced in the same way as Example 1 except that the coating solution used in preparing the ion conducting layer of the conductive roller was changed from the coating solution 1 to the following coating solution 48. The conductive roller obtained was evaluated as a charging roller in the same way. The formulation of the coating solution is shown in Table 20, and the results of evaluation are shown in Table 27. Also, binder resin raw materials O to R marked in Table 20 are shown in Table 21.

—Preparation of Coating Solution 48

0.13 g of 4-hydroxy-2-butanone and 0.40 g of the above reactive group-containing quaternary ammonium salt 1 were dissolved in ethanol, and the solution obtained was heated and refluxed for 24 hours, and thereafter the ethanol was evaporated off under reduced pressure. Into the residue having remained, 6.00 g of polyethylene oxide (number-average molecular weight: 300), 6.16 g of polypropylene oxide (number-average molecular weight: 1,000) and 7.84 g of an isocyanate compound (trade name: MILLIONATE MR-200; available from Nippon Polyurethane Industry Co., Ltd.) were mixed in a methyl ethyl ketone solvent, and the mixture obtained was so regulated as to be 35% by mass in solid content to obtain a coating solution 48. Here, in this coating solution 48, the EO content in the cationic group-immobilized electrically conducting resin having the structure represented by the formula (1) was 30% by mass.

Example 56

A conductive roller of Example 56 was produced in the same way as Example 51 except that the reactive group-containing quaternary ammonium salt 1 used in preparing the coating solution 44 was changed for a reactive group-containing quaternary ammonium salt 18 and that the binder resin raw materials were changed for materials shown in Table 20. The conductive roller obtained was evaluated as a charging roller in the same way. The formulation of the coating solution is shown in Table 20, and the results of evaluation are shown in Table 27.

TABLE 20

| | | Example | |
|---|---|---|---|
| | | 55 | 56 |
| | | Coating solution | |
| | | 48 | 49 |
| Reactive group = Containing quaternary ammonium salt | Type: | 1 | 18 |
| | Amount (pbm) | 2 | 2 |
| Binder resin raw materials | Types: | O/P/Q/R | O/P/Q/R |
| | Amount (pbm ratio) | 0.7/29.8/30.6/38.9 | 0.7/29.8/30.6/38.9 |
| EO content (% by mass) | | 30 | 30 |

TABLE 21

| Type | Binder resin raw materials |
|---|---|
| O | 4-Hydroxybutanone (available from Tokyo Chemical Industry Co., Ltd.) |
| P | Polyethylene oxide (number-average molecular weight: 300; available from Sigma-Aldrich Corporation) |
| Q | Polypropylene oxide (available from Sigma-Aldrich Corporation) |
| R | Isocyanate compound (trade name: MILLIONATE MR-200; available from Nippon Polyurethane Industry Co., Ltd.) |

Comparative Examples 1 to 4

Conductive rollers of Comparative Examples 1 to 4 were produced in the same way as Example 1 except that coating solutions 50 to 53 were used in which the reactive group-containing quaternary ammonium salt 1 added in preparing the coating solution 1 was changed for the following reactive group-containing quaternary ammonium salts, respectively. The conductive rollers obtained were evaluated as charging rollers in the same way.

The reactive group-containing quaternary ammonium salts used in Comparative Examples 1 to 4 were non-reactive benzyltrimethylammonium chloride, non-reactive benzyltrimethylammonium tetrafluorosulfonyl imide, glycidyltrimethylammonium chloride, and glycidyltrimethylammonium tetrafluorosulfonyl imide, respectively. The results of evaluation are shown in Table 28.

TABLE 22

| | | Example: | | | | |
|---|---|---|---|---|---|---|
| | | 1 | 2 | 3 | 4 | 5 |
| Base layer | | NBR | NBR | NBR | NBR | NBR |
| (Ev. 2) Base layer resistivity (Ω · cm) | LL | 3.50E+05 | 3.50E+05 | 3.50E+05 | 3.50E+05 | 3.50E+05 |
| | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $CH_2$ | $CH_2$ | $CH_2$ | $CH_2$ | $CH_2$ |

TABLE 22-continued

| | | | | | | |
|---|---|---|---|---|---|---|
| $A_2$, $A_3$ | | Formula (4) | Formula (4) | Formula (4) | Formula (4) | Formula (4) |
| $R_4$-$R_8$ | | $R_4$, $R_5$, $R_6$ = Me | $R_4$, $R_5$, $R_6$ = Et | $R_4$, $R_5$, $R_6$ = n-Pr | $R_4$, $R_5$ = Me $R_6$ = octyl | $R_4$, $R_5$ = Me $R_6$ = tera-decyl |
| Anion | | TFSI | TFSI | TFSI | TFSI | TFSI |
| Amount of quaternary ammonium salt (ms. %) | | 2 | 2 | 2 | 2 | 2 |
| Ion conducting resin | AO | EO, PO | EO, PO | EO, PO | EO, PO | EO, PO |
| | EO content (ms. %) | 30 | 30 | 30 | 30 | 30 |
| Layer thickness (μm) | | 10 | 10 | 10 | 10 | 10 |
| (Ev. 1) Film resistivity (Ω · cm) | LL | 3.23E+06 | 3.78E+06 | 4.12E+06 | 8.23E+06 | 8.98E+06 |
| | HH | 1.47E+05 | 1.56E+05 | 1.67E+05 | 1.49E+05 | 1.53E+05 |
| Environmental variation FIG. | | 1.34 | 1.38 | 1.39 | 1.74 | 1.77 |
| Roller construction | | 2 layers | 2 layers | 2 layers | 2 layers | 2 layers |
| (Ev. 3) Bleeding | | A | A | A | B | B |
| (Ev. 4) Resistance change with time | | A | A | A | A | B |
| (Ev. 5) Sand disappearing voltage (V) | | 1,500 | 1,500 | 1,510 | 1,630 | 1,630 |

| | | Example: | | | | |
|---|---|---|---|---|---|---|
| | | 6 | 7 | 8 | 9 | 10 |
| Base layer | | NBR | NBR | NBR | NBR | NBR |
| (Ev. 2) Base layer resistivity (Ω · cm) | LL | 3.50E+05 | 3.50E+05 | 3.50E+05 | 3.50E+05 | 3.50E+05 |
| | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $CH_2$ | $CH_2$ | $CH_2$ | $CH_2$ | $CH_2$ |
| $A_2$, $A_3$ | | Formula (4) | Formula (5) | Formula (5) | Formula (5) | Formula (6) |
| $R_4$-$R_8$ | | $R_4$, $R_5$, $R_6$ = $CH_2CH_2OCH_2CH_2OCH_3$ | $R_7$ = Me n = 1 X = $CH_2$ | $R_7$ = Me n = 2 X = $CH_2$ | $R_7$ = Me n = 2 X = O | — |
| Anion | | TFSI | TFSI | TFSI | TFSI | TFSI |
| Amount of quaternary ammonium salt (ms. %) | | 2 | 2 | 2 | 2 | 2 |
| Ion conducting resin | AO | EO, PO | EO, PO | EO, PO | EO, PO | EO, PO |
| | EO content (ms. %) | 30 | 30 | 30 | 30 | 30 |
| Layer thickness (μm) | | 10 | 10 | 10 | 10 | 10 |
| (Ev. 1) Film resistivity (Ω · cm) | LL | 5.96E+06 | 7.18E+06 | 7.24E+06 | 6.78E+06 | 7.68E+06 |
| | HH | 9.87E+04 | 1.52E+05 | 1.57E+05 | 1.42E+05 | 1.51E+05 |
| Environmental variation FIG. | | 1.78 | 1.67 | 1.66 | 1.68 | 1.71 |
| Roller construction | | 2 layers | 2 layers | 2 layers | 2 layers | 2 layers |
| (Ev. 3) Bleeding | | B | A | A | A | A |
| (Ev. 4) Resistance change with time | | A | A | A | A | A |
| (Ev. 5) Sand disappearing voltage (V) | | 1,550 | 1,600 | 1,600 | 1,550 | 1,600 |

*Ev. stands for Evaluation. It also applies to other tables.

TABLE 23

| | | Example: | | | | |
|---|---|---|---|---|---|---|
| | | 11 | 12 | 13 | 14 | 15 |
| Base layer | | NBR | NBR | NBR | NBR | NBR |
| (Ev. 2) Base layer resistivity (Ω · cm) | LL | 3.50E+05 | 3.50E+05 | 3.50E+05 | 3.50E+05 | 3.50E+05 |
| | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $CH_2$ | $CH_2$ | $CH_2$ | $CH_2$ | $CH_2$ |

TABLE 23-continued

| | | | | | | |
|---|---|---|---|---|---|---|
| $A_2$, $A_3$ | | Formula (7) | Formula (7) | Formula (7) | Formula (7) | Formula (7) |
| $R_4$-$R_8$ | | $R_8$ = Me | $R_8$ = Et | $R_8$ = Pr | $R_8$ = Allyl | $R_8$ = Bu |
| Anion | | TFSI | TFSI | TFSI | TFSI | TFSI |
| Amount of quaternary ammonium salt (% by mass) | | 2 | 2 | 2 | 2 | 2 |
| Ion conducting resin | AO | EO, PO | EO, PO | EO, PO | EO, PO | EO, PO |
| | EO content (% by mass) | 30 | 30 | 30 | 30 | 30 |
| Layer thickness (μm) | | 10 | 10 | 10 | 10 | 10 |
| (Ev. 1) Film resistivity (Ω · cm) | LL | 6.19E+06 | 6.58E+06 | 6.81E+06 | 6.89E+06 | 7.01E+06 |
| | HH | 1.01E+05 | 1.19E+05 | 1.23E+05 | 1.22E+05 | 1.25E+05 |
| Environmental var. FIG. | | 1.79 | 1.74 | 1.74 | 1.75 | 1.75 |
| Roller construction | | 2 layers | 2 layers | 2 layers | 2 layers | 2 layers |
| (Ev. 3) Bleeding | | A | A | B | B | B |
| (Ev. 4) Resistance change with time | | A | A | A | A | B |
| (Ev. 5) Sand disappearing voltage (V) | | 1,550 | 1,550 | 1,550 | 1,550 | 1,600 |

| | | Example: | | | | |
|---|---|---|---|---|---|---|
| | | 16 | 17 | 18 | 19 | 20 |
| Base layer | | NBR | NBR | NBR | NBR | NBR |
| (Ev. 2) Base layer resistivity (Ω · cm) | LL | 3.50E+05 | 3.50E+05 | 3.50E+05 | 3.50E+05 | 3.50E+05 |
| | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $(CH_2)_2$ | $(CH_2)_2$ | $(CH_2)_3$ | $(CH_2)_3$ | $(CH_2)_6$ |
| $A_2$, $A_3$ | | Formula (4) | Formula (4) | Formula (4) | Formula (5) | Formula (4) |
| $R_4$-$R_8$ | | $R_4$, $R_5$, $R_6$ = Me | $R_4$, $R_5$ = Me $R_6$ = tetra-decyl | $R_4$, $R_5$, $R_6$ = Me | $R_7$ = Me n = 2 X = $CH_2$ | $R_4$, $R_5$, $R_6$ = Me |
| Anion | | TFSI | TFSI | TFSI | TFSI | TFSI |
| Amount of quaternary ammonium salt (% by mass) | | 2 | 2 | 2 | 2 | 2 |
| Ion conducting resin | AO | EO, PO | EO, PO | EO, PO | EO, PO | EO, PO |
| | EO content (% by mass) | 30 | 30 | 30 | 30 | 30 |
| Layer thickness (μm) | | 10 | 10 | 10 | 10 | 10 |
| (Ev. 1) Film resistivity (Ω · cm) | LL | 6.17E+06 | 9.12E+06 | 6.98E+06 | 6.52E+06 | 7.56E+06 |
| | HH | 1.54E+05 | 1.56E+05 | 1.53E+05 | 1.10E+05 | 1.53E+05 |
| Environmental var. FIG. | | 1.60 | 1.77 | 1.66 | 1.77 | 1.69 |
| Roller construction | | 2 layers | 2 layers | 2 layers | 2 layers | 2 layers |
| (Ev. 3) Bleeding | | A | B | A | A | A |
| (Ev. 4) Resistance change with time | | A | B | A | B | B |
| (Ev. 5) Sand disappearing voltage (V) | | 1,550 | 1,630 | 1,600 | 1,600 | 1,600 |

TABLE 24

| | | Example: | | | | |
|---|---|---|---|---|---|---|
| | | 21 | 22 | 23 | 24 | 25 |
| Base layer | | NBR | NBR | NBR | NBR | NBR |
| (Ev. 2) | LL | 3.50E+05 | 3.50E+05 | 3.50E+05 | 3.50E+05 | 3.50E+05 |
| Base layer resistivity (Ω · cm) | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $(CH_2)_6$ | $(CH_2)_{10}$ | $(CH_2)_{10}$ | CHCH3—$CH_2$ *2 | $CHCH_3$—$CH_2CH_2$ *2 |
| $A_2$, $A_3$ | | Formula (6) | Formula (4) | Formula (7) | Formula (4) | Formula (4) |
| $R_4$-$R_8$ | | — | $R_4$, $R_5$, $R_6$ = Me | $R_8$ = Pr | $R_4$, $R_5$, $R_6$ = Me | $R_4$, $R_5$, $R_6$ = Me |
| Anion | | TFSI | TFSI | TFSI | TFSI | TFSI |
| Amount of quaternary ammonium salt (ms. %) | | 2 | 2 | 2 | 2 | 2 |
| Ion conducting resin | AO | EO, PO | EO, PO | EO, PO | EO, PO | EO, PO |
| | EO content (ms. %) | 30 | 30 | 30 | 30 | 30 |
| Layer thickness (μm) | | 10 | 10 | 10 | 10 | 10 |
| (Ev. 1) Film resistivity (Ω · cm) | LL | 9.01E+06 | 8.09E+06 | 8.54E+06 | 8.41E+06 | 8.87E+06 |
| | HH | 1.51E+05 | 1.67E+05 | 1.70E+05 | 1.75E+05 | 1.74E+05 |
| Environmental variation FIG. | | 1.78 | 1.69 | 1.70 | 1.68 | 1.71 |
| Roller construction | | 2 layers | 2 layers | 2 layers | 2 layers | 2 layers |
| (Ev. 3) Bleeding | | B | A | B | B | B |
| (Ev. 4) Resistance change with time | | B | B | B | B | B |
| (Ev. 5) Sand disappearing voltage (V) | | 1,630 | 1,620 | 1,630 | 1,630 | 1,630 |

| | | Example: | | | | |
|---|---|---|---|---|---|---|
| | | 26 | 27 | 28 | 29 | 30 |
| Base layer | | NBR | NBR | NBR | NBR | NBR |
| (Ev. 2) | LL | 3.50E+05 | 3.50E+05 | 3.50E+05 | 3.50E+05 | 3.50E+05 |
| Base layer resistivity (Ω · cm) | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $CH_2$ | $CH_2$ | $CH_2$ | $CH_2$ | $CH_2$ |
| $A_2$, $A_3$ | | Formula (4) | Formula (4) | Formula (4) | Formula (4) | Formula (4) |
| $R_4$-$R_8$ | | $R_4$, $R_5$, $R_6$ = Me | $R_4$, $R_5$, $R_6$ = Me | $R_4$, $R_5$, $R_6$ = Me | $R_4$, $R_5$, $R_6$ = Me | $R_4$, $R_5$, $R_6$ = Me |
| Anion | | TFSI | TFSI | TFSI | TFSI | TFSI |
| Amount of quaternary ammonium salt (ms. %) | | 1 | 8 | 2 | 2 | 2 |
| Ion conducting resin | AO | EO, PO | EO, PO | PO | EO, PO | EO, PO |
| | EO content (ms. %) | 30 | 30 | 0 | 10 | 50 |
| Layer thickness (μm) | | 10 | 10 | 10 | 10 | 10 |
| (Ev. 1) Film resistivity (Ω · cm) | LL | 6.14E+06 | 1.29E+06 | 3.22E+07 | 1.01E+07 | 2.77E+06 |
| | HH | 1.65E+05 | 7.30E+04 | 1.47E+06 | 4.90E+05 | 7.36E+04 |
| Environmental variation FIG. | | 1.57 | 1.25 | 1.34 | 1.31 | 1.58 |
| Roller construction | | 2 layers | 2 layers | 2 layers | 2 layers | 2 layers |
| (Ev. 3) Bleeding | | A | B | B | A | A |
| (Ev. 4) Resistance change with time | | B | A | A | A | A |
| (Ev. 5) Sand disappearing voltage (V) | | 1,550 | 1,500 | 1,650 | 1,630 | 1,500 |

*2 in "$R_2$, $R_3$" of Examples 24 and 25 represents the position of bonding on $A_2$ or $A_3$.

TABLE 25

| | | Example: | | | | |
|---|---|---|---|---|---|---|
| | | 31 | 32 | 33 | 34 | 35 |
| Base layer | | NBR | NBR | BR | NBR | NBR |
| (Ev. 2) Base layer resistivity (Ω · cm) | LL | 3.50E+05 | 3.50E+05 | 3.50E+05 | 3.50E+05 | 3.50E+05 |
| | HH | 3.68E+05 | 3.68E+05 | 3.68E+05 | 3.68E+05 | 3.68E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $CH_2$ | $CH_2$ | $CH_2$ | $CH_2$ | $CH_2$ |
| $A_2$, $A_3$ | | Formula (4) | Formula (4) | Formula (4) | Formula (4) | Formula (4) |
| $R_4$-$R_8$ | | $R_4$, $R_5$, $R_6$ = Me | $R_4$, $R_5$, $R_6$ = Me | $R_4$, $R_5$, $R_6$ = Me | $R_4$, $R_5$, $R_6$ = Me | $R_4$, $R_5$, $R_6$ = Me |
| Anion | | TFSI | Cl | Br | $ClO_4$ | NFSI |
| Amount of quaternary ammonium salt (% by mass) | | 2 | 2 | 2 | 2 | 2 |
| Ion conducting resin | AO | EO, BO | EO, PO | EO, PO | EO, PO | EO, PO |
| | EO content (% by mass) | 30 | 30 | 30 | 30 | 30 |
| Layer thickness (μm) | | 10 | 10 | 10 | 10 | 10 |
| (Ev. 1) Film resistivity (Ω · cm) | LL | 3.12E+06 | 5.23E+06 | 5.56E+06 | 4.23E+06 | 3.67E+06 |
| | HH | 1.47E+05 | 1.17E+05 | 1.23E+05 | 1.49E+05 | 1.73E+05 |
| Environmental variation FIG. | | 1.33 | 1.65 | 1.66 | 1.45 | 1.33 |
| Roller construction | | 2 layers | 2 layers | 2 layers | 2 layers | 2 layers |
| (Ev. 3) Bleeding | | A | B | B | A | A |
| (Ev. 4) Resistance change with time | | A | B | B | B | A |
| (Ev. 5) Sand disappearing voltage (V) | | 1,500 | 1,550 | 1,550 | 1,550 | 1,500 |

| | | Example: | | | | |
|---|---|---|---|---|---|---|
| | | 36 | 37 | 38 | 39 | 40 |
| Base layer | | NBR | NBR | NBR | NBR | Hydrin |
| (Ev. 2) Base layer resistivity (Ω · cm) | LL | 3.50E+05 | 3.50E+05 | 9.20E+04 | 8.50E+05 | 2.90E+07 |
| | HH | 3.68E+05 | 3.68E+05 | 9.66E+04 | 8.93E+05 | 8.00E+05 |
| Ion conducting layer: | | | | | | |
| Formula No. | | 2, 3 | 2, 3 | 2, 3 | 2, 3 | 2, 3 |
| $R_1$ | | — | — | — | — | — |
| $R_2$, $R_3$ | | $CH_2$ | $CH_2$ | $CH_2$ | $CH_2$ | $CH_2$ |
| $A_2$, $A_3$ | | Formula (4) | Formula (4) | Formula (4) | Formula (4) | Formula (4) |
| $R_4$-$R_8$ | | $R_4$, $R_5$, $R_6$ = Me | $R_4$, $R_5$, $R_6$ = Me | $R_4$, $R_5$, $R_6$ = Me | $R_4$, $R_5$, $R_6$ = Me | $R_4$, $R_5$, $R_6$ = Me |
| Anion | | TFSI | TFSI | TFSI | TFSI | TFSI |
| Amount of quaternary ammonium salt (% by mass) | | 2 | 2 | 2 | 2 | 2 |
| Ion conducting resin | AO | EO, PO | EO, PO | EO, PO | EO, PO | EO, PO |
| | EO content (% by mass) | 30 | 30 | 30 | 30 | 30 |
| Layer thickness (μm) | | 2 | 20 | 10 | 10 | 10 |
| (Ev. 1) Film resistivity (Ω · cm) | LL | 3.33E+06 | 3.20E+06 | 3.21E+06 | 3.19E+06 | 3.33E+06 |
| | HH | 1.57E+05 | 1.47E+05 | 1.47E+05 | 1.47E+05 | 1.48E+05 |
| Environmental variation FIG. | | 1.33 | 1.34 | 1.34 | 1.34 | 1.35 |
| Roller construction | | 2 layers | 2 layers | 2 layers | 2 layers | 2 layers |
| (Ev. 3) Bleeding | | A | A | A | A | A |
| (Ev. 4) Resistance change with time | | B | A | A | A | A |
| (Ev. 5) Sand disappearing voltage (V) | | 1,500 | 1,500 | 1,500 | 1,500 | 1,650 |

TABLE 26

| | | Example: | | | | | | | | | |
|---|---|---|---|---|---|---|---|---|---|---|---|
| | | 41 | 42 | 43 | 44 | 45 | 46 | 47 | 48 | 49 | 50 |
| Base layer | | NBR | — | NBR | NBR | NBR | NBR | NBR | NBR | NBR | NBR |
| (Ev. 2) | LL | 3.50E+05 | — | 3.50E+05 | 3.50E+05 | 3.50E+05 | 3.50E+05 | 3.50E+05 | 3.50E+05 | 3.50E+05 | 3.50E+05 |
| Base layer resistivity (Ω · cm) | HH | 3.68E+05 | — | 3.68E+05 | 3.68E+05 | 3.68E+05 | 3.68E+05 | 3.68E+05 | 3.68E+05 | 3.68E+05 | 3.68E+05 |
| | | Ion conducting layer: | | | | | | | | | |
| Formula No. | | 2, 3 | 2, 3 | 2, 3 | 2, 3 | 2, 3 | 2, 3 | 2, 3 | 2, 3 | 2, 3 | 2, 3 |
| $R_1$ | | — | — | — | — | — | — | — | — | — | — |
| $R_2$, $R_3$ | | $CH_2$ | $CH_2$ | $CH_2$ | $CH_2$ | $CH_2$ | $(CH_2)_2$ | $CH_2$ | $(CH_2)_3$ | $CH_2$ | $(CH_2)_6$ |
| $A_2$, $A_3$ | | Formula (4) | Formula (4) | Formula (4) | Formula (4) | Formula (4) | Formula (4) | Formula (4) | Formula (5) | Formula (4) | Formula (6) |
| $R_4$-$R_8$ | | $R_4$, $R_5$, $R_6$ = Me | $R_4$, $R_5$, $R_6$ = Me | $R_4$, $R_5$, $R_6$ = Me | $R_4$, $R_5$, $R_6$ = n-Pr | $R_4$, $R_5$, $R_6$ = Me | $R_4$, $R_5$, $R_6$ = $R_6$ = tetra-decyl | $R_4$, $R_5$, $R_6$ = Me | $R_7$ = Me n = 2 X = $CH_2$ | $R_4$, $R_5$, $R_6$ = Me | — |
| Anion | | TFSI | TFSI | TFSI | TFSI | TFSI | TFSI | TFSI | TFSI | TFSI | TFSI |
| Amount of quaternary ammonium salt (% by mass) | | 2 | 2 | 2 | 2 | 2 | 2 | 2 | 2 | 2 | 2 |
| Ion conducting resin | AO | EO, PO | EO, PO | EO | EO | EO | EO | EO | EO | EO | EO |
| | EO content (% by mass) | 30 | 30 | 30 | 30 | 30 | 30 | 30 | 30 | 30 | 30 |
| Layer thickness (μm) | | 10 | 1,250 | 5 | 5 | 5 | 5 | 10 | 10 | 2 | 2 |
| (Ev. 1) Film resistivity (Ω · cm) | LL | 3.30E+06 | 3.35E+06 | 8.52E+06 | 9.01E+06 | 8.13E+06 | 8.62E+06 | 7.09E+06 | 7.61E+06 | 9.15E+06 | 9.69E+06 |
| | HH | 1.50E+05 | 1.56E+05 | 2.19E+05 | 2.50E+05 | 2.00E+05 | 2.18E+05 | 1.43E+05 | 1.63E+05 | 2.05E+05 | 2.15E+05 |
| Environmental variation FIG. | | 1.34 | 1.33 | 1.59 | 1.56 | 1.61 | 1.60 | 1.70 | 1.67 | 1.65 | 1.65 |
| Roller construction | | 3 layers | 1 layer | 2 layers | 2 layers | 2 layers | 2 layers | 2 layers | 2 layers | 2 layers | 2 layers |
| (Ev. 3) Bleeding | | A | A | B | B | B | B | A | A | B | B |
| (Ev. 4) Resistance change with time | | B | A | B | B | B | B | A | A | B | B |
| (Ev. 5) Sand disappearing voltage (V) | | 1,520 | 1,600 | 1,620 | 1,620 | 1,620 | 1,620 | 1,600 | 1,600 | 1,620 | 1,630 |

TABLE 27

| | | Example: | | | | | |
|---|---|---|---|---|---|---|---|
| | | 51 | 52 | 53 | 54 | 55 | 56 |
| Base layer | | NBR | NBR | NBR | NBR | NBR | NBR |
| (Ev. 2) Base layer resistivity (Ω · cm) | LL | 3.50E+05 | 3.50E+05 | 3.50E+05 | 3.50E+05 | 3.50E+05 | 3.50E+05 |
| | HH | 3.68E+05 | 3.68E+05 | 3.68E+05 | 3.68E+05 | 3.68E+05 | 3.68E+05 |
| | | Ion conducting layer: | | | | | |
| Formula No. | | 1 | 1 | 1 | 1 | 1 | 1 |
| $R_1$ | | $CH_2$ | $(CH_2)_{10}$ | $CH_2$ | $CHCH_3$—$CH_2$—$CH_2$ *3 | $CH_2$ | $(CH_2)_3$ |
| $R_2$, $R_3$ | | — | — | — | — | — | — |
| $A_1$ | | Formula (4) | Formula (7) | Formula (4) | Formula (4) | Formula (4) | Formula (4) |
| $R_4$-$R_8$ | | $R_4$, $R_5$, $R_6$ = Me | $R_8$ = Pr | $R_4$, $R_5$, $R_6$ = Me | $R_4$, $R_5$, $R_6$ = Me | $R_4$, $R_5$, $R_6$ = Me | $R_4$, $R_5$, $R_6$ = Me |
| Anion | | TFSI | TFSI | TFSI | TFSI | TFSI | TFSI |
| Amount of quaternary ammonium salt (% by mass) | | 2 | 2 | 2 | 2 | 2 | 2 |
| Ion conducting resin | AO | EO | EO | EO | EO | EO, PO | EO, PO |
| | EO content (% by mass) | 30 | 30 | 30 | 30 | 30 | 30 |
| Layer thickness (μm) | | 10 | 10 | 2 | 2 | 10 | 10 |
| (Ev. 1) Film resistivity (Ω · cm) | LL | 7.23E+06 | 7.91E+06 | 8.23E+06 | 8.64E+06 | 4.98E+06 | 5.34E+06 |
| | HH | 1.20E+05 | 1.37E+05 | 1.74E+05 | 1.81E+05 | 1.93E+05 | 2.01E+05 |
| Environmental variation FIG. | | 1.78 | 1.76 | 1.67 | 1.68 | 1.41 | 1.42 |

TABLE 27-continued

| | Example: | | | | | |
|---|---|---|---|---|---|---|
| | 51 | 52 | 53 | 54 | 55 | 56 |
| Roller construction | 2 layers | 2 layers | 2 layers | 2 layers | 2 layers | 2 layers |
| (Ev. 3) Bleeding | A | A | A | A | A | A |
| (Ev. 4) Resistance change with time | A | A | A | B | A | A |
| (Ev. 5) Sand disappearing voltage (V) | 1,600 | 1,600 | 1,620 | 1,620 | 1,550 | 1,550 |

*3 in "$R_1$" of Example 54 represents the position of bonding on $A_1$.

TABLE 28

| | | Comparative Example: | | | |
|---|---|---|---|---|---|
| | | 1 | 2 | 3 | 4 |
| Base layer | | NBR | NBR | NBR | NBR |
| (Ev. 2) Base layer resistivity (Ω · cm) | LL | 3.50E+05 | 3.50E+05 | 3.50E+05 | 3.50E+05 |
| | HH | 3.68E+05 | 3.68E+05 | 3.68E+05 | 3.68E+05 |
| Ion conducting layer: | | | | | |
| Formula No. | | — | — | — | — |
| $R_1$ | | — | — | — | — |
| $R_2$, $R_3$ | | — | — | — | — |
| $A_1$-$A_3$ | | — | — | — | — |
| $R_4$-$R_8$ | | — | — | — | — |
| Anion | | Cl | TFSI | Cl | TFSI |
| Amount of quaternary ammonium salt (% by mass) | | Bezyltrimethyl-ammonium (2) | Bezyltrimethyl-ammonium (3) | Glycidyltrimethyl-ammonium (2) | Glycidyltrimethyl-ammonium (3) |
| Ion conducting resin | AO | EO, PO | EO, PO | EO, PO | EO, PO |
| | EO content (% by mass) | 10 | 10 | 10 | 10 |
| Layer thickness (μm) | | 10 | 10 | 10 | 10 |
| (Ev. 1) Film resistivity (Ω · cm) | LL | 4.45E+06 | 4.02E+06 | 9.72E+06 | 8.26E+06 |
| | HH | 1.02E+05 | 1.51E+05 | 2.09E+05 | 2.17E+05 |
| Environmental variation figure | | 1.64 | 1.43 | 1.67 | 1.58 |
| Roller construction | | 2 layers | 2 layers | 2 layers | 2 layers |
| (Ev. 3) Bleeding | | D | C | B | A |
| (Ev. 4) Resistance change with time | | D | C | D | C |
| (Ev. 5) Sand disappearing voltage (V) | | 1,550 | 1,520 | 1,630 | 1,630 |

Production of Developing Roller

Example 57

As an electrically conducting substrate (mandrel), a mandrel was used which was made of SUS stainless steel, having been plated with nickel and having been further coated thereon with an adhesive (primer) and then baked. This mandrel was disposed in a mold, and materials the kinds and amounts of which are shown in Table 29 below were in-situ mixed, and thereafter the mixture obtained was casted into a cavity having been formed in the mold, pre-heated to 120° C., in which the mandrel was kept disposed. Subsequently, this mold was heated at 120° C. to effect vulcanization and curing of liquid silicone rubber, followed by cooling and then demolding to obtain a conductive elastic roller made of silicone rubber and having a diameter of 12 mm. Thereafter, end portions of its conduction layer was so cut and removed that the electrically conducting layer had a length of 228 mm in the axial direction of the mandrel.

TABLE 29

| Materials | Amount; part(s) by mass |
|---|---|
| Liquid silicone rubber ((trade name: SE6724A/B; available from Dow Corning Toray Silicone Co., Ltd.) | 100 |
| Carbon black (trade name: TOKA BLACK #7360SB; available from Tokai Carbon Co., Ltd.) | 35 |
| Silica powder | 0.2 |
| Platinum catalyst | 0.1 |

A conductive roller of Example 57 was produced in the same way as Example 1 except that the conductive elastic roller used in Example 1 was changed for this conductive elastic roller made of silicone rubber.

Next, the conductive roller produced was put to the following evaluation tests, as a developing roller.

Characteristics Evaluation

The electrical resistivity of the ion conducting layer and that of the base layer (elastic layer) were measured in the same way as Evaluation 1 and Evaluation 2 given previously.

Evaluation was also made in the same way as the test method for bleeding of the charging roller, described previously (in Evaluation 3), except that the conductive roller was incorporated as a developing roller into the process cartridge for the electrophotographic laser beam printer (trade name: LASERJET CP4525dn; manufactured by Hewlett-Packard Company). This evaluation was given as Evaluation 6, and the results thereof are shown in Table 30.

Image Evaluation

Evaluation 7: Evaluation of Image Density (Resistance Change with Time).

In order to make evaluation on any image density decrease due to resistance change with time of the developing roller in a low temperature and low humidity environment, the conductive roller produced was left to stand for a month in an environment of temperature 15° C. and humidity 10% RH (L/L). Next, in this L/L environment, this conductive roller was fitted as a developing roller to a process cartridge for a color laser beam printer (trade name: COLOR LASERJET CP2025dn; manufactured by Japan Hewlett-Packard Company), and an image with a print percentage of 100% was reproduced on 1 sheet. As a toner, a magenta toner carried in the process cartridge was used as it was.

Thereafter, the developing roller was taken out of the process cartridge, and the toner on the developing roller surface was removed by air blowing, and thereafter the developing roller was placed on the jig for measuring the resistance change with time, shown in FIGS. 4A and 4B, where the columnar metal 42 was rotated at 30 rpm and at the same time a direct voltage of −200 V was applied for 30 minutes. The developing roller having been put to such resistance change with time was again incorporated into the process cartridge, and an image with a print percentage of 100% was reproduced on 1 sheet. Here, a series of operations was all done in the L/L environment.

The images obtained before and after the resistance change with time were examined with a reflection densitometer (trade name: TC-6DS/A; manufactured by Tokyo Denshoku Technical Center Company Ltd.) to measure their reflection densities. An arithmetic mean value of values measured at 10 spots on each image was taken as the value of image density.

A difference in image density before resistance change with time and after resistance change with time was found by the following expression to make evaluation according to the following criteria.

Image density difference=|image density before resistance change with time−image density after resistance change with time|

A: Less than 0.05.
B: 0.05 or more to less than 0.10.
C: 0.10 or more to 0.20 or less.
D: More than 0.20.

Comparative Example 5

A conductive roller of Comparative Example 5 was obtained in the same way as Comparative Example 4 except that the conductive elastic roller used in Comparative Example 4 was changed for the above conductive elastic roller made of silicone rubber. The conductive roller obtained was evaluated as a developing roller in the same way as Example 57. The results of evaluation are shown in Table 30.

TABLE 30

| | | Example 57 | Comparative Example 5 |
|---|---|---|---|
| Base layer | | Silicone | Silicone |
| (Ev. 2) Base layer resistivity (Ω · cm) | LL | 3.93E+05 | 3.93E+05 |
| | HH | 4.32E+05 | 4.32E+05 |
| Ion conducting layer: | | | |
| Formula No. | | 2, 3 | — |
| $R_1$ | | — | — |
| $R_2$, $R_3$ | | $CH_2$ | — |
| $A_1$ | | Formula (4) | — |
| $R_4$-$R_8$ | | $R_4$, $R_5$, $R_6$ = Me | — |
| Anion | | TFSI | TFSI |
| Amount of quaternary ammonium salt (% by mass) | | 2 | Glycidyltrimethylammonium (2) |
| Ion conducting resin | AO | EO, PO | EO, PO |
| | EO content (% by mass) | 30 | 30 |
| Layer thickness (μm) | | 10 | 10 |
| (Ev. 1) Film resistivity (Ω · cm) | LL | 3.23E+06 | 8.26E+06 |
| | HH | 1.47E+05 | 2.17E+05 |
| Environmental variation figure | | 1.34 | 1.58 |
| Layer construction on conductive shaft member | | 2 layers | 2 layers |
| (Ev. 6) Bleeding | | A | A |
| (Ev. 7) Resistance change with time | | A | C |

Example 58

The conductive roller produced in Example 53 was incorporated as a primary transfer roller into a process cartridge for an electrophotographic laser beam printer (trade name: COLOR LASERJET CP4525dn; manufactured by Hewlett-Packard Company). Then, a running test was conducted in an environment of temperature 23° C. and humidity 50% RH. The running test was a test in which an intermittent image forming operation such that, after images were reproduced on 2 sheets, the rotation of a photosensitive drum was completely stopped for about 3 seconds and then the images were again started to be reproduced was repeated to reproduce electrophotographic images on 40,000 sheets. The images reproduced on that occasion were such images that alphabet letters "E" of 4-point in size were so printed as to be 1% in coverage with respect to the area of an A-4 size sheet.

Next, the conductive roller was again incorporated as the primary transfer roller into this process cartridge, and images were reproduced to make evaluation. The images were all evaluated in an environment of temperature 15° C. and humidity 10% RH, and by reproducing halftone (an image in which horizontal lines were each drawn in a width of 1 dot and at intervals of 2 dots in the direction perpendicular to the rotational direction of the photosensitive member) images. As the result, good images were obtained without any problem.

As having been described above, the use of the conductive member of the present invention makes a sufficient conductivity attainable even in a low temperature and low humidity environment, and enables the electrically conducting layer to less cause the resistance change with time and the ion conducting agent to be kept from bleeding. Then, as the result, this enables its electrical resistance value to be optimized without dependence on service conditions and setup environments, so that an electrically conducting member for electrophotography can be obtained which contributes to stable formation of high-grade electrophotographic images.

According to the present invention, a process cartridge and an electrophotographic image forming apparatus can also be obtained which can form high-grade electrophotographic images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-277496, filed Dec. 19, 2011, and Japanese Patent Application No. 2012-252745, filed Nov. 16, 2012, which are hereby incorporated by reference herein in their entirety.

What is claimed is:

1. An electrically conducting member for electrophotography comprising an electrically conducting substrate and an electrically conducting layer, wherein;

the electrically conducting layer comprises a resin having in the molecule at least one structure selected from the group consisting of structures represented by the following formula (1), formula (2) and formula (3):

Formula (1)

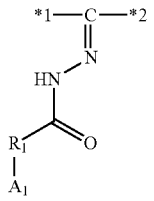

Formula (2)

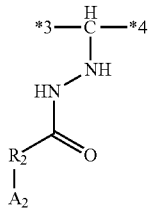

Formula (3)

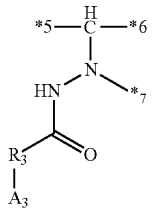

where, in the formulas (1) to (3), $R_1$ to $R_3$ each independently represent an alkylene group having 1 to 10 carbon atom(s); and asterisks *1 to *7 each independently represent a hydrogen atom or the position of bonding with the carbon atom in the molecular structure of the resin, provided that at least one of *1 and *2, at least one of *3 and *4 and at least one point selected from *5 to *7 represents the position of bonding with the carbon atom in the molecular structure of the resin;

$A_1$ to $A_3$ each independently represent any structure selected from the group consisting of structures represented by the following formula (4), formula (5), formula (6) and formula (7):

Formula (4)

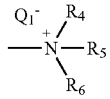

Formula (5)

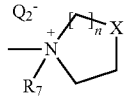

Formula (6)

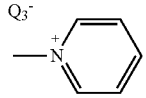

Formula (7)

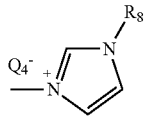

where, in the formulas (4) to (7), $Q_1^-$ to $Q_4^-$ each independently represent an anion;

$R_4$ to $R_8$ each independently represent an alkyl group having 1 to 8 carbon atom(s) which has been substituted with an oxyalkylene group having 1 to 4 carbon atom(s), an allyl group, or an alkyl group having 1 to 14 carbon atom(s);

X represents a methylene group or an oxygen atom; and n represents 1 or 2.

2. The conductive member for electrophotography according to claim 1, wherein $R_1$ in the formula (1) represents a methylene group, and $A_1$ represents the structure represented by the formula (4), where $R_4$ to $R_6$ in the formula (4) each independently represent an alkyl group having 1 to 3 carbon atom(s).

3. The conductive member for electrophotography according to claim 1, wherein the resin has the structure represented by the formula (2), where;

$R_2$ in the formula (2) represents a methylene group, and $A_2$ represents the structure represented by the formula (4), where $R_4$ to $R_6$ in the formula (4) each independently represent an alkyl group having 1 to 3 carbon atom(s).

4. The conductive member for electrophotography according to claim 1, wherein the resin has the structure represented by the formula (3), where;

$R_3$ in the formula (3) represents a methylene group, and $A_3$ represents the structure represented by the formula (4), where $R_4$ to $R_6$ in the formula (4) each independently represent an alkyl group having 1 to 3 carbon atom(s).

5. The conductive member for electrophotography according to claim 1, wherein the anion is a perfluorosulfonyl imide ion represented by the following formula (8):

Formula (8)

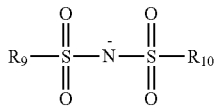

where, in the formula (8), $R_9$ and $R_{10}$ each independently represent a perfluoroalkyl group having 1 to 4 carbon atom(s).

6. A process cartridge which is so constituted as to be detachably mountable to the main body of an electrophotographic image forming apparatus, and comprises the conductive member for electrophotography according to claim 1.

7. An electrophotographic image forming apparatus which comprises the conductive member for electrophotography according to claim 1.

* * * * *

UNITED STATES PATENT AND TRADEMARK OFFICE

CERTIFICATE OF CORRECTION

PATENT NO. : 8,771,818 B2
APPLICATION NO. : 13/917532
DATED : July 8, 2014
INVENTOR(S) : Nishioka et al.

It is certified that error appears in the above-identified patent and that said Letters Patent is hereby corrected as shown below:

ON THE TITLE PAGE:

Item (30) Foreign Application Priority Data, add the following additional foreign priority document:

--Nov. 16, 2012 (JP)…….2012-252745--.

Signed and Sealed this
Seventeenth Day of November, 2015

Michelle K. Lee

Michelle K. Lee
*Director of the United States Patent and Trademark Office*